US009651202B2

(12) United States Patent
Derks et al.

(10) Patent No.: US 9,651,202 B2
(45) Date of Patent: May 16, 2017

(54) CONTACT ELEMENT, CLAMPING ELEMENT, BASE AND ARRANGEMENT FOR HOLDING AND CONTACTING AN LED

(71) Applicant: Tyco Electronics Nederland BV, s'Hertogenbosch (NL)

(72) Inventors: Henricus Egbertus Geert Derks, Schijndel (NL); Jasper Van Der Krogt, s'Hertogenbosch (NL); Peter Poorter, Wijk en Aalburg (NL)

(73) Assignee: TE Connectivity Nederland BV, S'Hertogenbosh (NL)

( * ) Notice: Subject to any disclaimer, the term of this patent is extended or adjusted under 35 U.S.C. 154(b) by 0 days.

(21) Appl. No.: 14/389,762

(22) PCT Filed: Mar. 21, 2013

(86) PCT No.: PCT/EP2013/055938
§ 371 (c)(1),
(2) Date: Sep. 30, 2014

(87) PCT Pub. No.: WO2013/149845
PCT Pub. Date: Oct. 10, 2013

(65) Prior Publication Data

US 2015/0055356 A1 Feb. 26, 2015

(30) Foreign Application Priority Data

Apr. 2, 2012 (EP) ..... 12162853

(51) Int. Cl.
*H01R 13/24* (2006.01)
*H01R 33/09* (2006.01)
(Continued)

(52) U.S. Cl.
CPC ..... *F21K 9/30* (2013.01); *F21K 9/20* (2016.08); *F21K 9/65* (2016.08); *F21V 19/0055* (2013.01);
(Continued)

(58) Field of Classification Search
CPC ..... H01R 4/4818; H01R 13/24; H01R 33/09; H01R 13/2442; H01R 13/71; H01R 35/04
(Continued)

(56) References Cited

U.S. PATENT DOCUMENTS 2,925,479 A 2/1960 Marasco
3,144,527 A 8/1964 Tolegian
(Continued)

FOREIGN PATENT DOCUMENTS

FR 2870083 A1 11/2005
JP S61174748 A 8/1986
WO WO 2011/088212 7/2011

OTHER PUBLICATIONS

International Search Report and Written Opinion issued by the European Patent Office, dated Apr. 10, 2013, for International Application No. PCT/EP2013/055938; 13 pages.
(Continued)

*Primary Examiner* — James Harvey
*Assistant Examiner* — Matthew T Dzierzynski
(74) *Attorney, Agent, or Firm* — Faegre Baker Daniels LLP

(57) ABSTRACT

The present invention relates to a contact element (3, 3', 3"), a base (2, 2', 2", 2'''), a clamping element (4, 4', 4"), an arrangement (1, 1', 1", 1''', 1'''', 1''''') and a mounting section (301, 301', 301") for electrically contacting a light-emitting diode (LED) (100, 100'). In order to conveniently and cost-effectively hold and electrically contact the LED (100, 100'), the present invention provides that the contact
(Continued)

element (3, 3') comprises a mounting section (301, 301') adapted for mounting the contact element (3, 3') to the base (2, 2') in a manner that the contact element (3, 3') is pivotable about a pivot axis (P) extending through the mounting section (301, 301'), and comprises a contact arm (302, 302') protruding laterally from the mounting section (301, 301') and having on a distal end a contact point (303) facing essentially in a contact direction (K) for contacting the LED (100), wherein the contact direction is running essentially in parallel to the pivot axis (P). Further, the invention provides that the base (2, 2', 2") comprises at least one contact receptacle (203, 203', 203") which is adapted to accommodate a contact element (3, 3') according to at least one of claims 1 to 10 in at least to different rotational positions (R1, R2), and that the clamping element (4, 4', 4") comprises an attachment section (401, 401') adapted to be attached to the base (2, 2') at the at least one contact receptacle (203, 203', 203"), and a holding section (402, 402') adapted to hold down the contact arm (302, 302') of the contact element (3, 3') towards the LED (100, 100').

26 Claims, 18 Drawing Sheets

(51) Int. Cl.

| | |
|---|---|
| ***H01R 33/18*** | (2006.01) |
| ***F21K 99/00*** | (2016.01) |
| ***H01R 13/631*** | (2006.01) |
| ***F21V 19/00*** | (2006.01) |
| ***F21V 21/00*** | (2006.01) |
| ***F21V 21/14*** | (2006.01) |
| ***F21K 9/20*** | (2016.01) |
| ***F21K 9/65*** | (2016.01) |
| *H01R 13/71* | (2006.01) |
| *H01R 35/04* | (2006.01) |

(52) U.S. Cl.
CPC ..... *F21V 21/00* (2013.01); *F21V 21/14* (2013.01); *H01R 13/24* (2013.01); *H01R 13/631* (2013.01); *H01R 13/6315* (2013.01); *H01R 33/09* (2013.01); *H01R 33/18* (2013.01); *H01R 13/71* (2013.01); *H01R 35/04* (2013.01)

(58) Field of Classification Search
USPC ... 257/E33.066, E33.077, E51.018, 103, 79, 257/99; 439/500, 56, 68, 70, 71, 11, 13, 439/862
See application file for complete search history.

(56) References Cited

U.S. PATENT DOCUMENTS

| | | | | |
|---|---|---|---|---|
| 4,430,009 | A * | 2/1984 | Muller | G04C 10/00 368/202 |
| 4,591,961 | A * | 5/1986 | Myles | F21V 15/04 362/306 |
| 4,763,308 | A * | 8/1988 | Morata | G04C 10/00 368/204 |
| 6,036,336 | A * | 3/2000 | Wu | F21K 9/13 362/249.03 |
| 6,965,544 | B2 * | 11/2005 | Watanabe | G04C 10/00 368/203 |
| 7,927,131 | B2 * | 4/2011 | Chen | H01R 13/245 439/500 |
| 8,435,040 | B2 * | 5/2013 | Costabel | B60R 13/0206 439/34 |
| 8,569,786 | B2 * | 10/2013 | Takei | F21S 8/086 257/103 |
| 9,239,152 | B2 * | 1/2016 | Ho | F21V 19/0055 |
| 2006/0060881 | A1 | 3/2006 | Anderlini | |
| 2011/0111632 | A1 | 5/2011 | Naito | |
| 2012/0156920 | A1 * | 6/2012 | Sakai | H01R 4/4818 439/387 |
| 2013/0077326 | A1 * | 3/2013 | Zantout | F21V 21/088 362/396 |
| 2014/0268887 | A1 * | 9/2014 | Schroll | F21K 9/30 362/652 |
| 2015/0109801 | A1 * | 4/2015 | McGowan | F21K 9/30 362/370 |
| 2015/0131299 | A1 * | 5/2015 | Meyer | F21V 17/10 362/373 |

OTHER PUBLICATIONS

International Preliminary Report on Patentability issued by the European Patent Office, dated Oct. 7, 2014, for related International Patent Application No. PCT/EP2013/055938; 9 pages.

European Search Report issued by the European Patent Office, dated Nov. 12, 2012, for European Patent Application No. 12162853; 9 pages.

Communication pursuant to Article 94(3) of the European Patent Convention issued by the European Patent Office, dated Mar. 30, 2016, for related European Patent Application No. 12162853; 5 pages.

Response to the Communication pursuant to Article 94(3), dated Jun. 8, 2016, for related European Patent Application No. 12162853; 2 pages.

* cited by examiner

CONTACT ELEMENT, CLAMPING ELEMENT, BASE AND ARRANGEMENT FOR HOLDING AND CONTACTING AN LED

BACKGROUND

The present invention relates to a contact element for electrically contacting a light-emitting diode (LED).

Further, the present invention relates to a base for holding an LED.

Moreover, the present invention relates to a clamping element for clamping a contact element for electrically contacting an LED.

Furthermore, the present invention relates to an arrangement for holding and electrically contacting an LED.

Finally, the present invention relates to a mounting section for mounting an electrical contact to a substrate, such as a base for holding an electrically contacting LED.

The use of LED's is currently increasing in numerous application areas. Especially in lighting applications, LED's may be provided as modules, wherein the LED element is embedded on a substrate, which may be a printed circuit board (PCB) for example. The so-called high-power LED's may for instance be used for lighting applications with 30 W up to 80 W and more. Such lighting applications may be found for example in electronics, instrumentation and measuring equipment, machine tools, audiovisual equipment, home appliances and alike.

There is a constant desire to provide cost-effective mounting solutions for holding and electrically contacting the LED. Preferably, solutions for easily mounting LED's of different sizes and power specifications are desired. Thus, a problem underlying the present invention is to find a cost-efficient mounting arrangement, i.e. assembly or construction kit for mounting LED's, which is easily adaptable to different LED's and/or applications.

SUMMARY

This problem is solved with the above-mentioned contact element according to the present invention in that the contact element comprises a mounting section adapted for mounting the contact element to a base in a manner in which the contact element is pivotable about a pivot axis extending through the mounting section, and a contact arm protruding laterally from the mounting section and having on a distal end a contact point facing essentially in a contact direction for contacting the LED, wherein the contact direction runs essentially in parallel to the pivot axis.

For a base mentioned in the beginning of the description, the above-mentioned problem is solved in that the base comprises at least one contact receptacle, which is adapted to accommodate a contact element according to the present invention in at least two different rotational positions.

For a clamping element mentioned in the beginning of the description, the above-mentioned is solved in that the clamping element comprises an attachment section adapted to be attached to the base at the least one contact receptacle, and a holding section adapted to hold down the contact arm of the contact element towards the LED.

For an arrangement mentioned in the beginning of the description, the above-mentioned problem is solved in that the arrangement comprises at least one of a contact element, a base, and a clamping element according to the present invention.

For a mounting section mentioned in the beginning of the description, the above-mentioned problem is solved in that the mounting section comprises a base part and a top part, which are placed above each other in an insertion direction in which the mounting section is adapted to be mated with the substrate.

The solution allows different sized LED's and LED-modules to be used respectively, with the same contact elements, basis and/or clamping elements, by adapting the rotational position of the clamping elements to contact pads, i.e. LED contact, on the LED or LED-module, respectively. Hence, contact elements, bases, clamping elements and mounting sections according to the present invention can be produced in high numbers which improves their cost-effectiveness. Further, contacting and/or holding an LED or LED-module with a contact element, a base, a clamping element and/or by means of a mounting section according to the present invention is easy and the number of tools required therefor is very low, which further helps in reducing the costs in handling LED's and LED-modules.

In the following, further improvements of the contact element, the base, the clamping element, the arrangement and/or the mounting section according to the present invention are described. These additional improvements may be combined independently of each other, depending on whether a particular advantage of a particular improvement is needed in a specific application.

According to a first advantageous improvement of the contact element, the mounting section may provide an opening for mounting the contact element to the base and the pivot axis may extend axially through the opening. The opening may facilitate defining the pivot axis such that the contact element and especially the contact arm protruding therefrom is pivotable along a defined radius, along which the contact point may be aligned to an electrical contact of the LED. Precisely rotating or pivoting the contact element may be further facilitated in that the opening may at least in sections have an annular shape.

The contact arm may at least in sections be resiliently deflectable in the contact direction. Thereby, contact forces acting in the contact direction onto the electrical contact of the LED are uniformly applied. Further, vibrations and tolerances may be compensated for due to the resiliency of the contact arm, which may elastically be deformed when brought into contact with an electrical contact of the LED.

The mounting section may comprise at least one spring element providing resiliency of the mounting section at least partly in parallel with the pivot access. Thereby, the mounting section may be elastically deformable such that it may be compressed and exert a spring force along a direction in parallel with the pivot axis, when being arranged between a base and a mounting element for holding the LED. The mounting element may for example be a screw, clamp, clamping element, rivet or alike.

The mounting section may comprise at least two ring members arranged above each other along the pivot axis. The two ring members may provide a precise compression and pre-defined spring characteristics of the mounting section, especially along the pivot axis. The at least two ring members may comprise at least one base part and at least one top part. The base part may face towards the base such that it supports the mounting section at the base and the top part may face towards a clamping or mounting element in order to be pushed towards the base part, when the contact element is affixed to the base.

The at least two ring members may be connected to each other via a bridge element. The bridge element may at least in sections extend along the direction of the pivot axis and may be resilient at least along a direction of the pivot axis and may constitute a spring element. Thereby, the bridge element may provide or enhance compressibility and elasticity of the mounting section, especially in a direction of the pivot axis.

A stop element may be arranged between the at least two ring members. The stop element may at least partly limit movements of the at least two ring members towards each other. Similarly to the bridge element, the stop element may thereby enhance the compressibility and elasticity of the mounting section in that it may act as a spring element. The bridge element and/or the spring element may for example be formed as at least one bow extending radially from the mounting section. In any case, the stop element may be resilient at least in parallel to the pivot axis.

At least one of the ring members may be broken and may have two free ends, which may be displaced with respect to each other in a direction in parallel to the pivot axis. The two free ends may be elastically displaceable with respect to each other such that the resiliency of the mounting section is further improved and the mounting section itself acts as a spring element. For example, the top part may be broken and provided with the two free ends such that it is elastically deformable, while the mounting section is supported on the base part.

The contact element may further comprise at least one lateral abutment face, which is adapted to limit a rotation of the contact element about its pivot axis. The lateral abutment face may for example be formed at a lateral side at one of the at least two ring members such that it defines an edge, at which the contact element may be laterally supported in order to limit its rotation.

For the base mentioned in the beginning of the description, the solution according to the present invention may be further improved in that the base can comprise an LED-receptacle adapted to accommodate the LED such that it is rotatable about a rotational axis extending through the LED-receptacle. Thereby, the LED may be rotated in order to align at least one of its electrical contacts with at least one contact point provided by the contact element in the contact direction. A rotational orientation of the contact element may also be adjusted to at least one electrical contact of the LED. Hence, by rotating at least one of the contact element and the LED, the solution according to the present invention allows for an easy adaptation of the respective electrical contacts to the respective size and dimensions of the LED.

For an arrangement mentioned in the beginning of the description, the solution according to the present invention may be further improved in that in a pre-assembled position, the contact element may be held captive in the contact receptacle by the clamping element. In other words, in the pre-assembled position, the contact element may be secured in the contact receptacle by the clamping element. The clamping element may therefore be provided with a latching means. Thereby, the clamping element may be latched to the base in order to hold the contact element between the clamping element and the base such that it does not get lost during shipping and handling before final assembly.

For a mounting section mentioned in the beginning of the description, the solution according to the present invention may be further improved in that the base part and the top part may be elastically displaceable with respect to each other at least in the insertion direction. Thereby, the mounting section may be spring-tensioned in order to be fixed in a certain rotational position. The resiliency of the mounting section allows vibrations and tolerances to be compensated for. A contact arm may be connected to the mounting section and may protrude laterally therefrom. On its distal end, the contact arm may have a contact point for electrically contacting the LED in a contact direction running essentially in parallel to the insertion direction.

The base part and the top part may be formed as ring members, respectively, arranged above each other in the insertion direction and/or contact direction. The base part and the top part may be connected to each other via a bridge element. A stop element may be arranged between the base part and the top part. The stop element may at least partly limit movements of the base part and the top part towards each other. The stop element may be resilient at least in parallel to the insertion direction and/or contact direction. At least one of the base part and the top part may be broken such that it has two free ends which may displaced with respect to each other in a direction parallel to the insertion direction and/or contact direction. The base part and/or the mounting section may further comprise at least one lateral abutment face which is adapted to limit a rotation of the mounting section about an axis of rotation or pivot axis running essentially in parallel to the insertion direction and/or contact direction.

In the following, the invention and its improvements are described in greater detail by using exemplary embodiments thereof and with reference to the accompanying drawings. As described above, the various features shown in the embodiments may be used independently of each other according to the respective requirements of specific applications.

DETAILED DESCRIPTION

Figure 1:
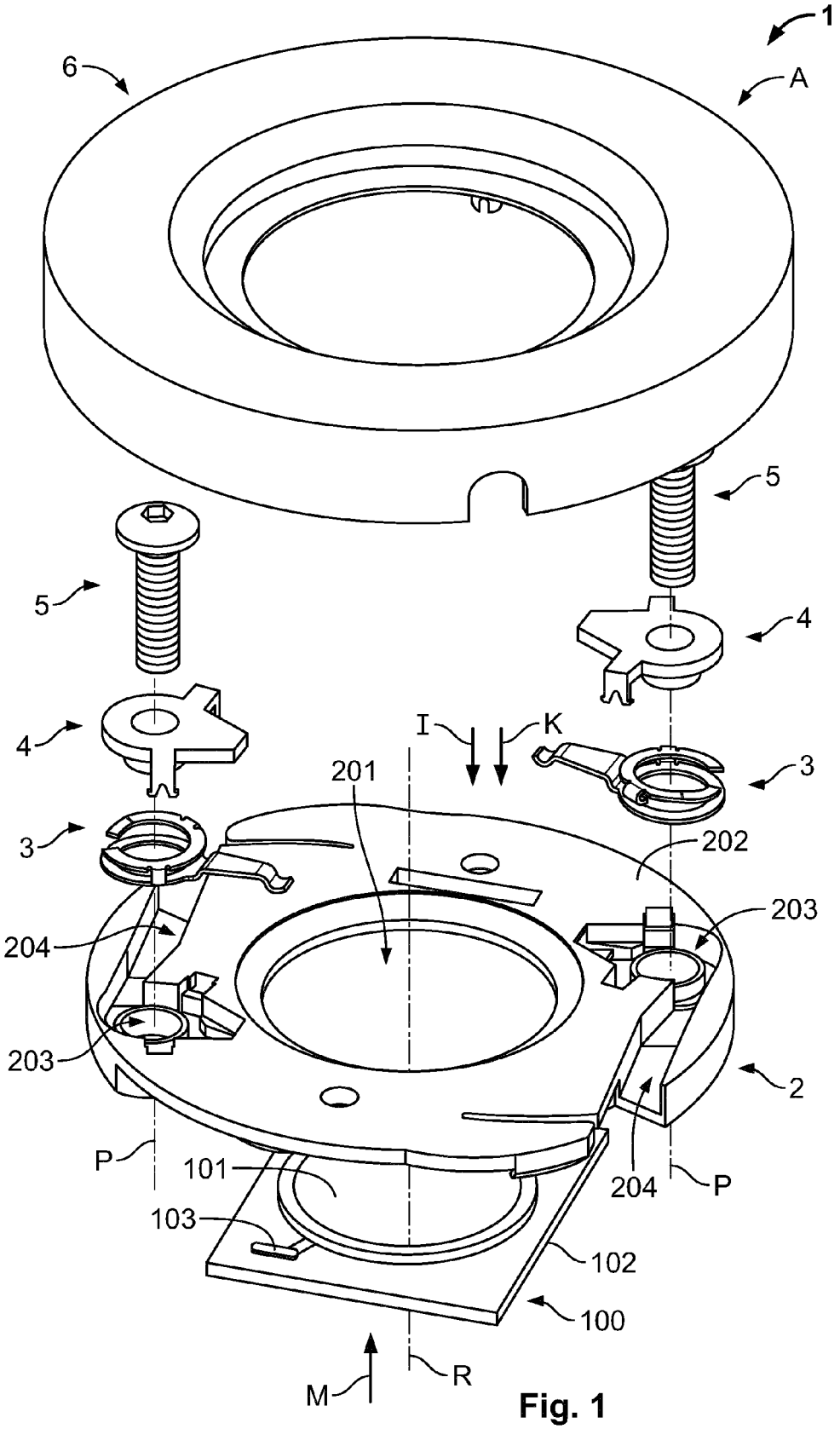
FIG. 1 shows a schematic exploded view of a first embodiment of an arrangement according to the present invention for holding and electrically contacting an LED.

FIG. 1 shows an embodiment of an arrangement 1 for holding and electrically contacting an LED or LED-module 100. For the sake of simplicity, the LED or LED-module 100 will jointly be referred to as LED throughout the description. The arrangement 1 comprises a base 2, two contact elements 3, two respective clamping elements 4, two respective mounting means or mounting elements 5 and a cover 6. In FIG. 1, the arrangement 1 is illustrated in a dismantled state A, wherein its elements, i.e. the base 2, the contact elements 3, the clamping elements 4, the mounting elements 5 and the cover 6 are ready to be mated and further, the LED 100 may be mated with the base 2.

The LED 100 comprises an LED element 101 that is supported on a substrate 102, which may be a printed circuit board (PCB). The LED element 101 is supplied with electrical power via at least two electrical LED contacts 103. The LED 100 and/or the base 2 are adapted such that the LED 100 may be mated with the base 2 in a mating direction M. In other words, the LED 100 is mated with the base 2 from below the base 2. The base 2 is provided with an orifice 201 for the LED element 101. The orifice 201 has an annular shape. In an essentially ring-shaped body portion 202 of the base 2, two contact receptacles 203 are formed, which are adapted to each accommodate one of the contact elements 3 as well as one of the clamping elements 4. Conductor channels 204 extend through the body portion 202 from the outside into the contact receptacles 203 in order to accommodate an electrical conductor and/or line (not yet shown).

The contact receptacles 203 are formed such that the contact elements 3 may each be inserted into the contact receptacles 203 in an insertion direction I, which runs opposite to the mating direction M. The insertion direction I runs in parallel and in the same direction as a contact direction K of the contact element 3 in which the contact element 3 contacts one of the LED-contacts in an electrically conductive manner. The clamping elements 4 are also to be inserted into the receptacles 203 in the insertion direction I. The mounting elements 5 are also designed to each be mated with the clamping elements 4, the contact elements 3 and the base 2 in the insertion direction I. The cover 6 is designed to be mated with the base 2 in the insertion direction I.

Figure 2:
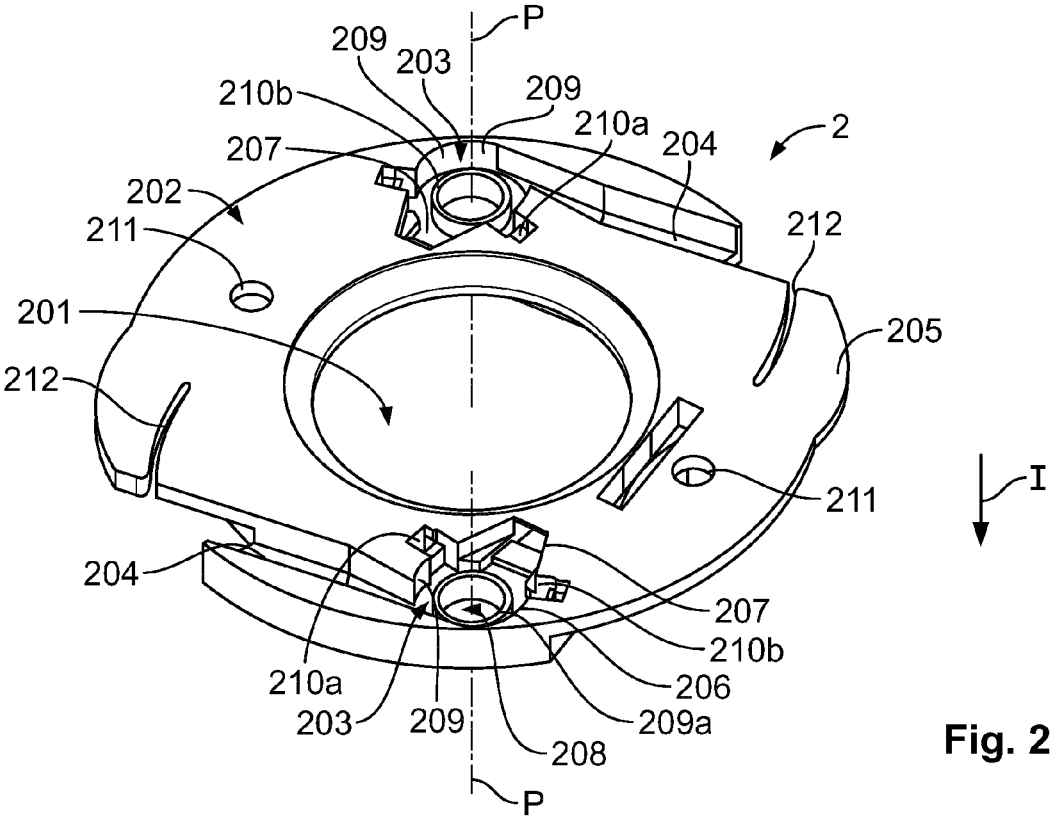
FIG. 2 is a schematic perspective view of a base which is used in the arrangement illustrated in FIG. 1 for holding the LED.

FIG. 2 shows a schematic perspective view of the base 2 and in particular of a top side 205 of the base 2. Each of the contact receptacles 203 is provided with a mounting portion 206 and a contact portion 207. The mounting portion 206 is adapted to accommodate a mounting section (not yet shown) of the contact element 3. The contact portion 207 is adapted to accommodate a contact section in the form of a contact arm (not yet shown) of the contact element 3.

The mounting portion 206 is provided with an opening in the form of a through-hole 208 which is surrounded by a collar 209 extending opposite to the insertion direction I annularly around the opening, i.e. through-hole 208. A pivot axis P extends axially through each of the through-holes 208. Each of the contact elements 3 is adapted to be pivoted around the pivot axis P. In two respective side walls 209 of the contact receptacles 203, counter latching elements 210*a* and 210*b* are formed, which are adapted to interact with latching elements (not yet shown) formed at the clamping elements 4. Moreover, a bush 209*a* in the form of a sleeve provides the other side walls which surround the through-hole 208. The base 2 is provided with attaching means 211 for attaching the cover 6 to the base 2. The attaching means 211 are formed as through-holes. Moreover, slits 212 having an arc-like shape are formed in the body portion 202, which facilitate a mounting of the base 2.

Figure 3:
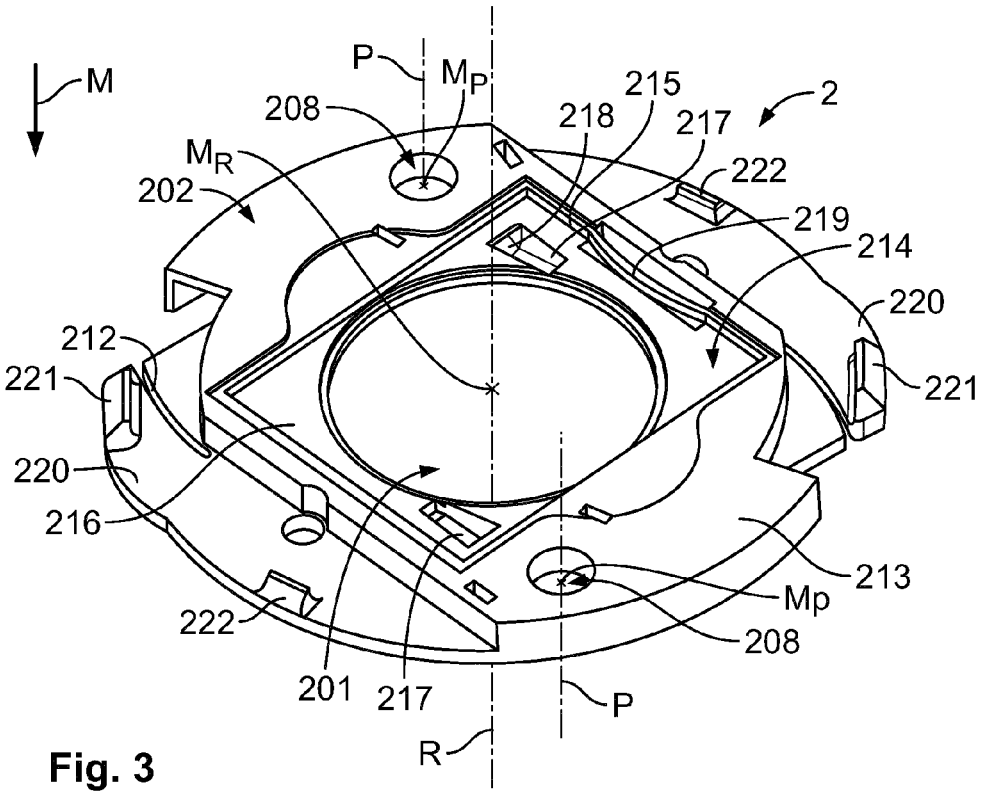
FIG. 3 is another schematic perspective view of the base illustrated in FIG. 2.

FIG. 3 shows the base 2 from below such that a bottom side 213 of the body portion 202 is visible. An LED-receptacle 214 is formed at the bottom side 213. The LED-receptacle 214 is surrounded by a frame 215. The frame 215 extends rectangularly around an abutment face 216 formed by the bottom of the receptacle 214. The abutment face 216 is adapted to support the substrate 102 of the LED 100. In the abutment face 216, two contact recesses 217 are formed for each accommodating an LED-contact.

The contact recesses 217 are each connected to the contact receptacles 203 via an aperture 218.

A locking element 219 in the form of a lamella is formed at one front side of the frame 215 and protrudes laterally into the LED-receptacle 214. The locking element 219 may be resilient such that it may lock or latch the LED 100 by positive fit, force fit and/or frictional fit. The orifice 201 is arranged at the centre of the LED-receptacle 214 such that a rotational axis R for the LED 100 extends axially through a centre point $M_R$ of the orifice 201. The centre point $M_R$ of the orifice 201 lies on the rotational axis R. The through-holes 208 extend through the body portion 202. Each of the pivot axes P for the contact elements 3 extends axially through the respective through-hole 208. A centre point $M_P$ of each of the through-holes 208 lies on the respective pivot axis P.

Further the slits 212 help in forming latching tongues 220. The latching tongues 220 are each provided with latching noses 221 for mounting the base 2 to any substrate or carrier on which the arrangement 1 is to be affixed. Additionally, further latching noses 222 are provided for affixing the arrangement 1.

Figure 4:
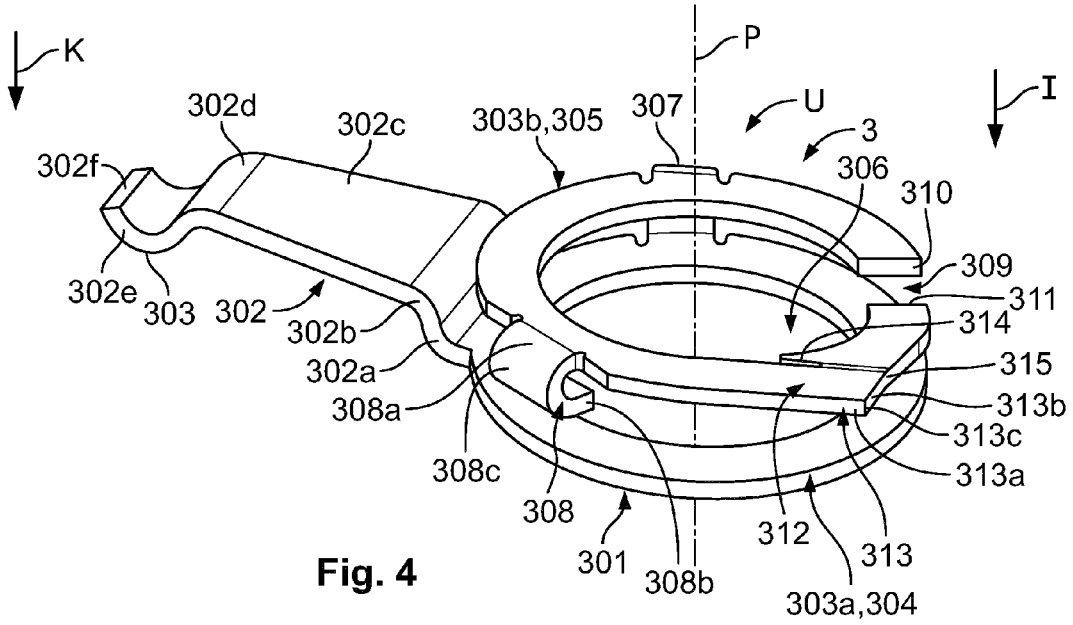
FIG. 4 is a schematic perspective view of a contact element according to an embodiment of the present invention used in the arrangement illustrated in FIG. 1.

FIG. 4 shows a schematic perspective view of the contact element 3. The contact element 3 comprises a mounting section 301 and a contact section in the form of a contact arm 302. The mounting section 301 comprises two ring members 303*a* and 303*b*. The ring member 303*a* forms a base part 304 of the contact element 3. The ring element 303*b* forms a top part 305 of the contact element 3. The base part 304 carries the contact arm 302 and has an essentially annular shape with an essentially circular aperture forming a lower part of an opening 306 through which the pivot axis P extends axially.

The top part 305 is connected to the base part 304 via a bridge element 307 in the form of a bow, the legs of which are connected to the base part 304 and the top part 305, respectively. A yoke of the bow extends essentially in parallel to the insertion direction I and the pivot axis P. A stop element 308 in the form of a bow which is similar in shape to the bridge element 307 is attached with its first leg 308*a* to the top part 305 while its second leg 308*b* extends essentially transversely to the insertion direction I and the pivot axis P. A yoke 308*c* connects the first leg 308*a* to the second leg 308*b* and at least partially extends in parallel to the insertion direction I and the pivot axis P.

A break 309 is formed in the top part 305 such that it is provided with a first free end 310 and a second free end 311. The first free end 310 and the second free end 311 are displaced with respect to each other in the insertion direction I and the direction of the pivot axis P. An upper part of the opening 306 is formed by the top part 305. The second free end 311 is arranged below the first free end 310, i.e. behind the first free end 310 in the insertion direction I. However, from the second free end 311, the top part 305 rises towards the stop element 308 such that a yielding section 312 is formed, which is designed to yield and bend down towards the base part 305 when exerting a force onto the top part 305 acting in the insertion direction I.

In the region of the yielding section 312, the contact element 3 is provided with essentially flat laterally abutment faces 313*a*, 313*b* extending perpendicularly or at least transversely with respect to each other such that an edge 313*c* is formed between them. Together, the lateral abutment faces 313*a*, 313*b* and the edge 313*c* form a locking member 313 of the contact element 3, which is designed to interact with the contact receptacle 203 such that rotational movements of the contact element about the pivot axis P may be limited. A notch 314 is formed between a section of the top part 305 leading towards the second free end 311 and the locking member 313, such that a deformation region 315 is provided, which facilitates a resilient deformation of the top part 305 in the region between the locking member 313 and the second free end 311.

The contact arm 302 is connected to the mounting section 301 via a first bend 302*a*, bending such that the contact arm 302 partly runs towards the insertion direction I, followed by a second bend 302*b*, where the contact arm 302 bends such that it extends essentially radially away from the mounting section 301. The second bend 302*b* leads into a cantilever portion 302*c* of the contact arm 302. The cantilever portion 302*c* leads into a third bend 302*d*, wherein the contact arm bends downwards at least partially into the insertion direction I and/or into the contact direction K. The third bend 302*d* is followed by a bow 302*e*, the yoke of which forms a contact point 303 of the contact element 3. A free end 302*f* of the bow 302*e* at least partially faces towards the insertion direction I and/or the contact direction K. The entire contact arm 302 tapers from the first bend 302*a* to its free end 302*f* such that the resiliency of the contact arm 302 increases from the first bend 302*a* towards the free end 302*f*.

Figure 5:
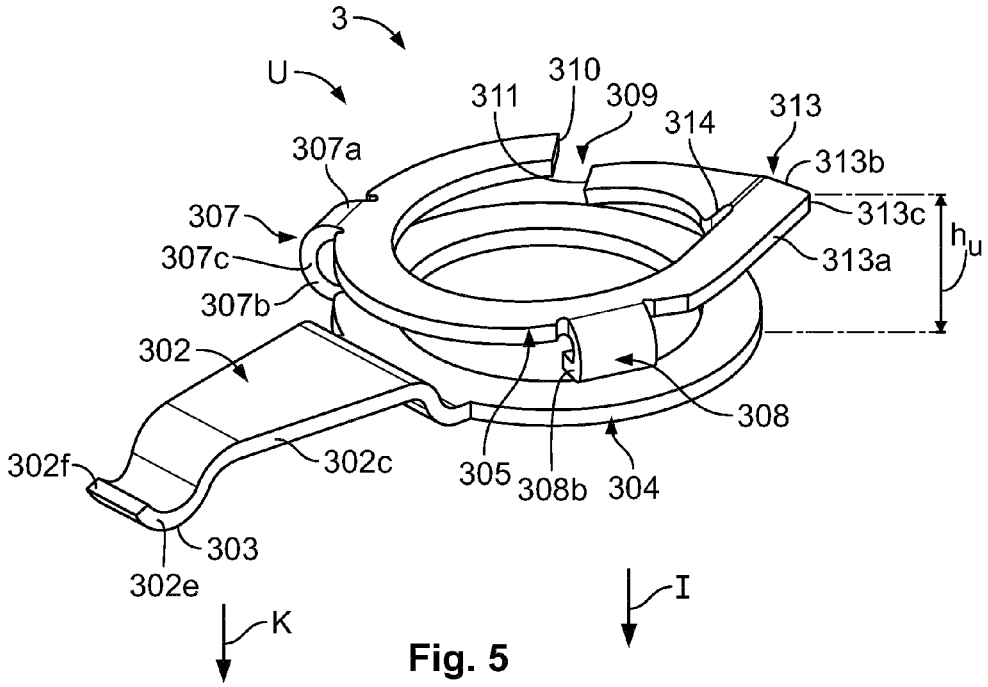
FIG. 5 is another schematic perspective view of the contact element illustrated in FIG. 4.

FIG. 5 shows the contact element 3 in another schematic perspective view in an uncompressed state U like in FIG. 4. In FIG. 5, it becomes apparent that in the uncompressed state U, the stop element 308 formed at the top part 305 and in particular the second leg 308*b* of the stop element 308 is distanced from the base part 304. The edge 313*c* at the locking member 313 forms the highest point of the contact element 3, i.e. at this point, the contact element may have its biggest height $h_U$ measured in parallel with the insertion direction I.

Further, it becomes apparent in FIG. 5 that the bridge element 307 is formed as a bow comprising a first leg 307*a* connected to the top part 305, a second leg 307*b* connected to the base part 304 and a yoke 307*c* extending between the first leg 307*a* and the second leg 307*b* and at least partially extending in parallel to the insertion direction I. Moreover, it becomes apparent in FIG. 5 that the cantilever portion 302*c* of the contact arm 302 is elevated with respect to the base part 304 and the bow 302*e* such that the contact point 303 protrudes from the contact arm 302 in the contact direction K.

Figure 6:
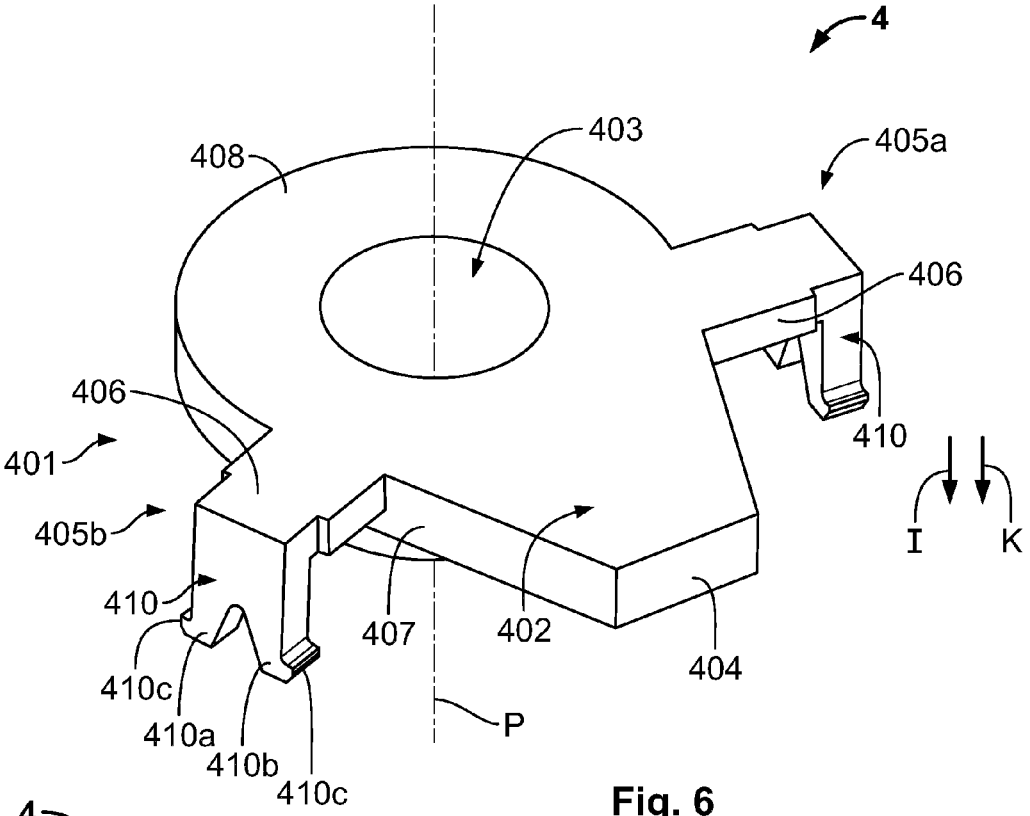
FIG. 6 is a schematic perspective view of a clamping element according to an embodiment of the present invention used in the arrangement illustrated in FIG. 1.

FIG. 6 shows a schematic perspective view of the clamping element 4. The clamping element 4 comprises an attachment section 401 adapted to be attached to the base 2 at the least one contact receptacle 203, and a holding section 402 adapted to hold down the contact arm 302 of the contact element 3 towards the LED 100. The attachment section 401 is provided with a bore 403, which extends through the attachment section 401 as a through-hole in parallel to the pivot axis P. In particular, the pivot axis P extends through the centre of the bore 403. The holding section 402 extends essentially perpendicularly with respect to the insertion direction I and contact direction K, i.e. laterally from the attachment section 401, and tapers towards its tip 404.

Further, the clamping element 4 is provided with two latching elements 405*a* and 405*b*. The latching elements 405*a* and 405*b* each comprise a cross-beam in the form of an arm 406 extending laterally, i.e. essentially perpendicularly with respect to the insertion direction I and contact direction K from the clamping element 4. In particular, the cross-beams 406 each are arranged at respective side faces 407 of the clamping element 4 in a way that they are aligned at their top with a top face 408 for the clamping element 4. The latching elements 405*a* and 405*b* are formed such that they each protrude below a bottom face 409 (not yet shown) of the clamping element 4 by means of a latching organ 410. The latching organs 410 each comprise latching arms 410*a*, 410*b*, which each are provided with latching noses 410*c*, which protrude essentially laterally, i.e. perpendicularly to the insertion direction I and contact direction K from the latching organs 410.

Figure 7:
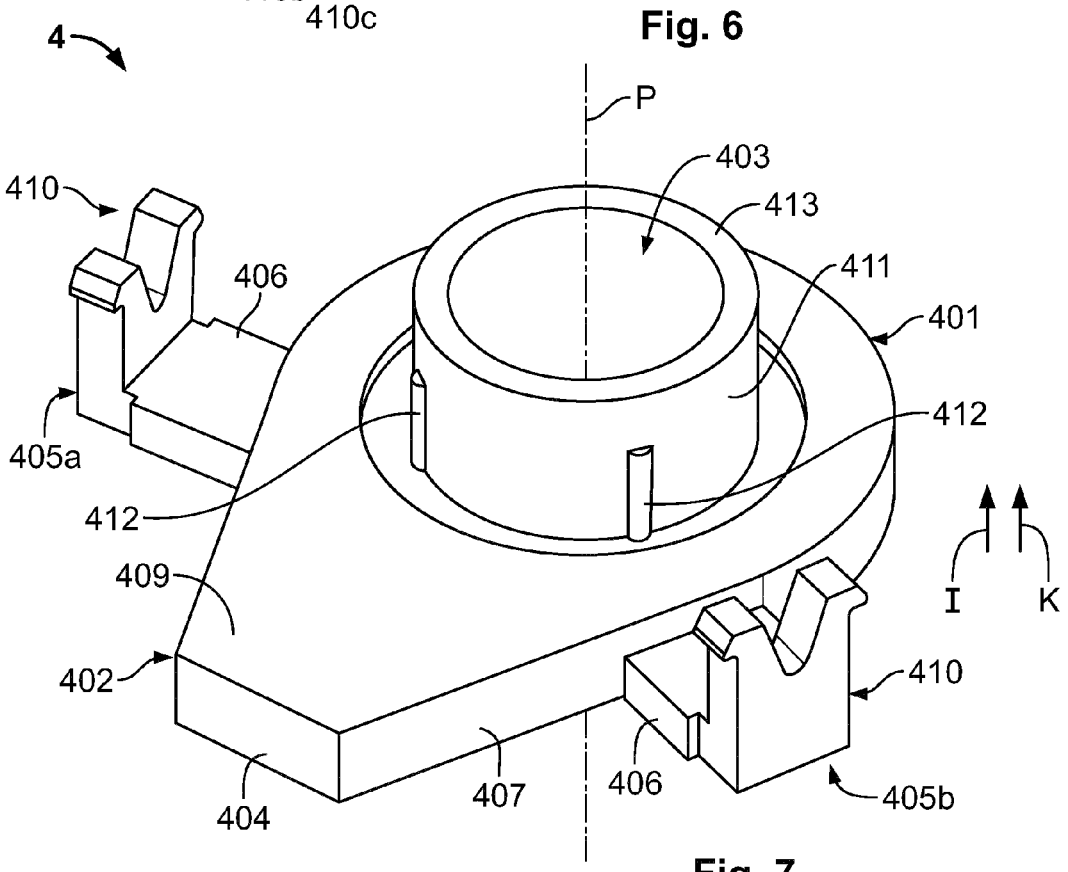
FIG. 7 is another schematic perspective view of the clamping element illustrated in FIG. 6.

FIG. 7 shows another schematic perspective view of the clamping element 4 showing the bottom face 409. Here it becomes apparent that a sleeve 411 protrudes from the bottom face 409 in the insertion direction I and the contact direction K. The sleeve 411 has a tubular and/or cylindrical shape and is provided with bosses 412 extending in parallel to the pivot axis on the outer circumference of the sleeve 411. A lower end 413 of the sleeve 411 extends beyond the latching organs 410 in the insertion direction I and the contact direction K. The bore 403 extends through the sleeve 411 and is at least partially formed by the inner circumference of the sleeve 411.

Figure 8:
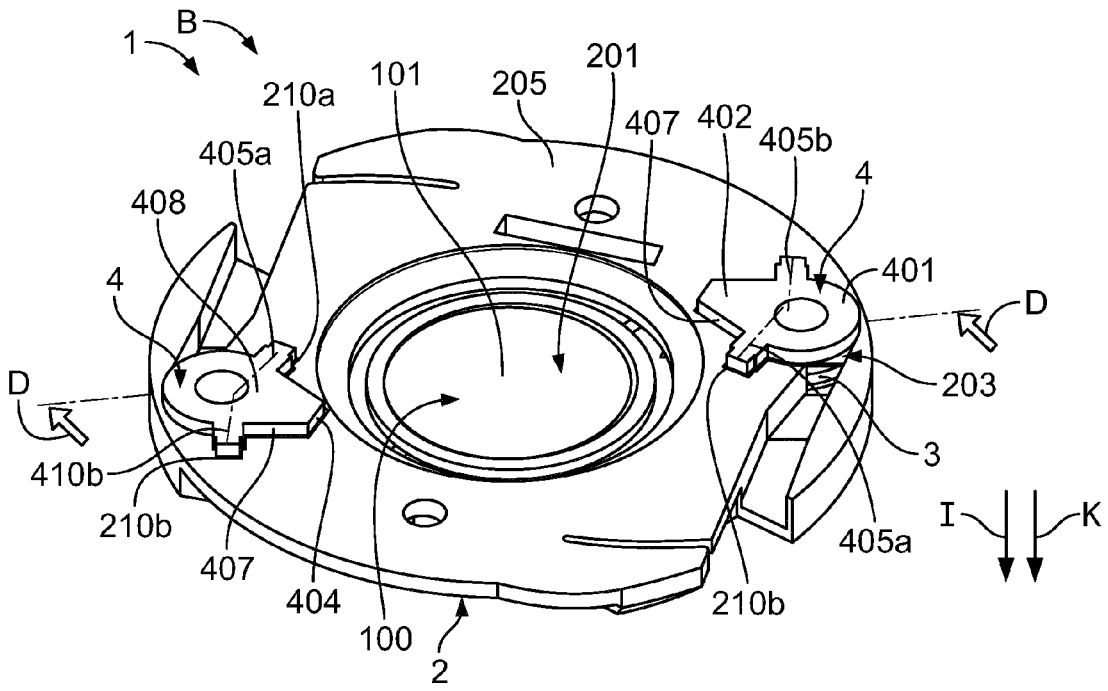
FIG. 8 is a schematic perspective view of the base, the clamping elements, the contact elements and the LED in a pre-assembled state of the arrangement illustrated in FIG. 1.

FIG. 8 shows the arrangement 1 in a schematic perspective view in a pre-assembled state B. In the pre-assembled state B, the contact elements 3 are inserted into their respective contact receptacles 203 within the base 2. The clamping elements 4 are partly inserted into the contact receptacles 203 such that the top faces 408 of the clamping elements 4 at least partially protrude above the top side 205 of the base 2. Hence, the side faces 407 and the tip 404 of the clamping elements 4 are visible. Also the latching elements 405*a* and 405*b* are at least partly inserted into the counter latching elements 210*a*, 210*b*, respectively, formed at the contact receptacles 203. Thereby, the clamping elements 4 are latched at the base 2 via the latching means 410*a*, 410*b* and counter latching elements 210*a*, 210*b* in the pre-assembled state B in that the latching elements 405*a*, 405*b* interact with the counter latching elements 210*a*, 210*b* so that the clamping elements 4 and therefore also the contact elements 3 are captively held in their respective contact receptacles 203. Hence, the contact elements 3 are prevented from falling out of the contact receptacles 203 in a direction opposite to the insertion direction I and contact direction K. Further, in the pre-assembled state B, the LED 100 may be arranged below the base 2 such that the LED element 101 is concentrically aligned with the orifice 201.

Figure 9:
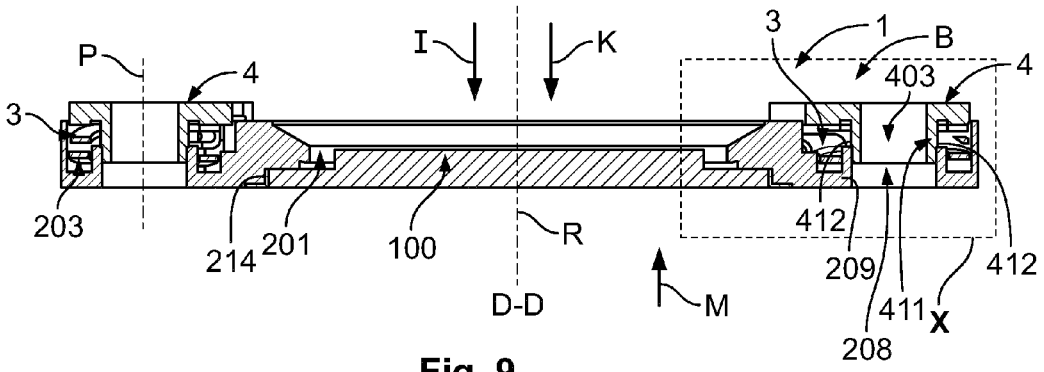
FIG. 9 is a schematic cross-sectional view along the cross-sectional line D-D illustrated in FIG. 8.

FIG. 9 is a schematic perspective view of the arrangement 1 in the pre-assembled state B along the cross-sectional line D-D depicted in FIG. 8. Here it becomes apparent that the contact elements 3 are fully arranged within the contact receptacles 203 and are held captively therein with the help of the clamping elements 4. The bosses 412 formed at the sleeves 411 abut on the top rim of the side walls 209 of the through-hole 208 such that the movement of the clamping elements 4 is limited in the insertion direction I and the contact direction K. Further, the LED 100 may be accommodated within the LED-receptacle 214. The LED 100 may slightly protrude into the orifice 201.

Figure 10:
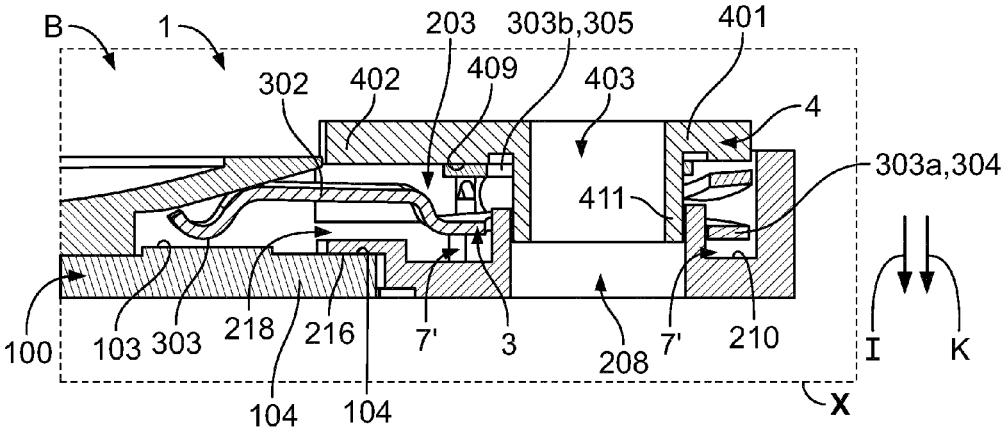
FIG. 10 is a detail X of the illustration shown in FIG. 9.

FIG. 10 shows a detail X depicted in FIG. 9 in a cross-sectional side view through the contact arm 302 of the contact element 3 within the contact receptacle 203. Here it becomes apparent that between the ring member 303*a* or base part 304 and a bottom 210 of the contact receptacle 203, a free space 7' with a certain height measured in parallel with the insertion direction I in the contact direction K is left for accommodating an electrical conductor 7 (not yet shown) for supplying the LED 100 with electrical power via the contact element 3. At the same time, the ring member 303*b* or the top part 305 may abut the bottom face 409 of the clamping element 4. Further, an abutment side 104 of the LED 100 may abut the abutment face 216 of the LED-receptacle 214. The contact arm 302 extends through the aperture 218 towards one of the LED contacts 103 arranged on the upper side 104 of the substrate 102 such that the contact point 303 may be arranged closely above the LED-contact 103.

Figure 11:
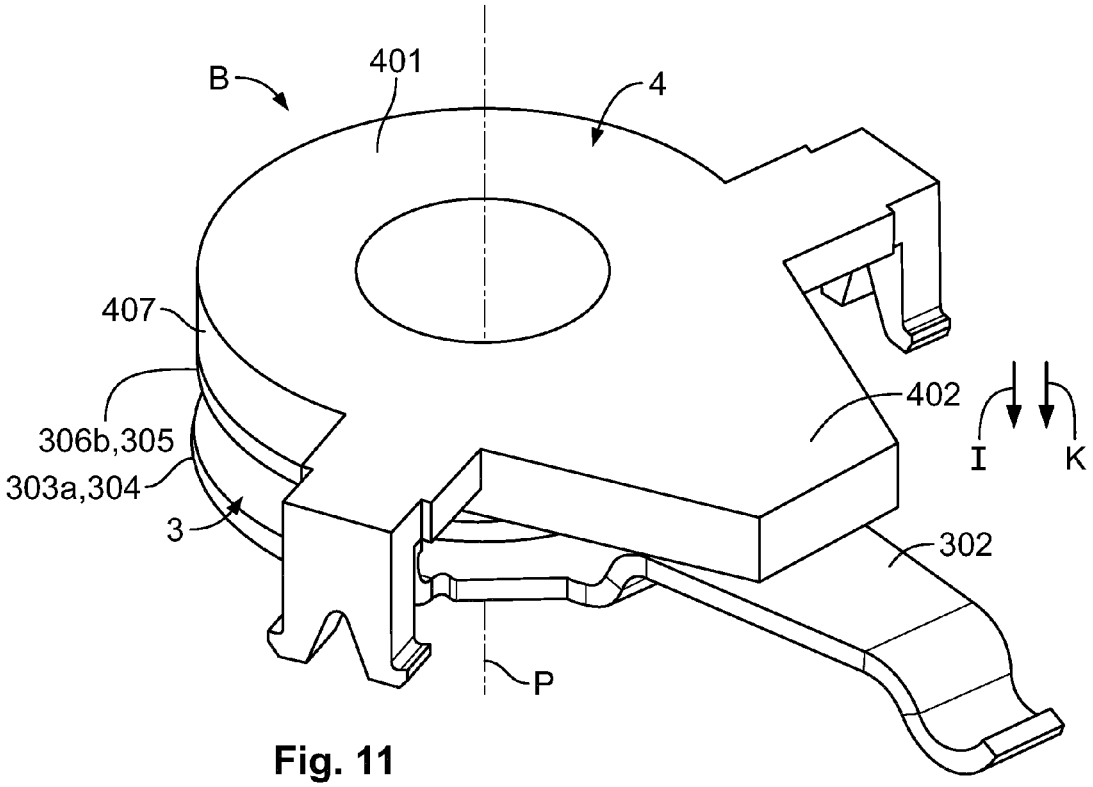
FIG. 11 is a schematic perspective view of the contact element and the clamping element in the pre-assembled state used in the arrangement illustrated in FIG. 1.
Figure 12:
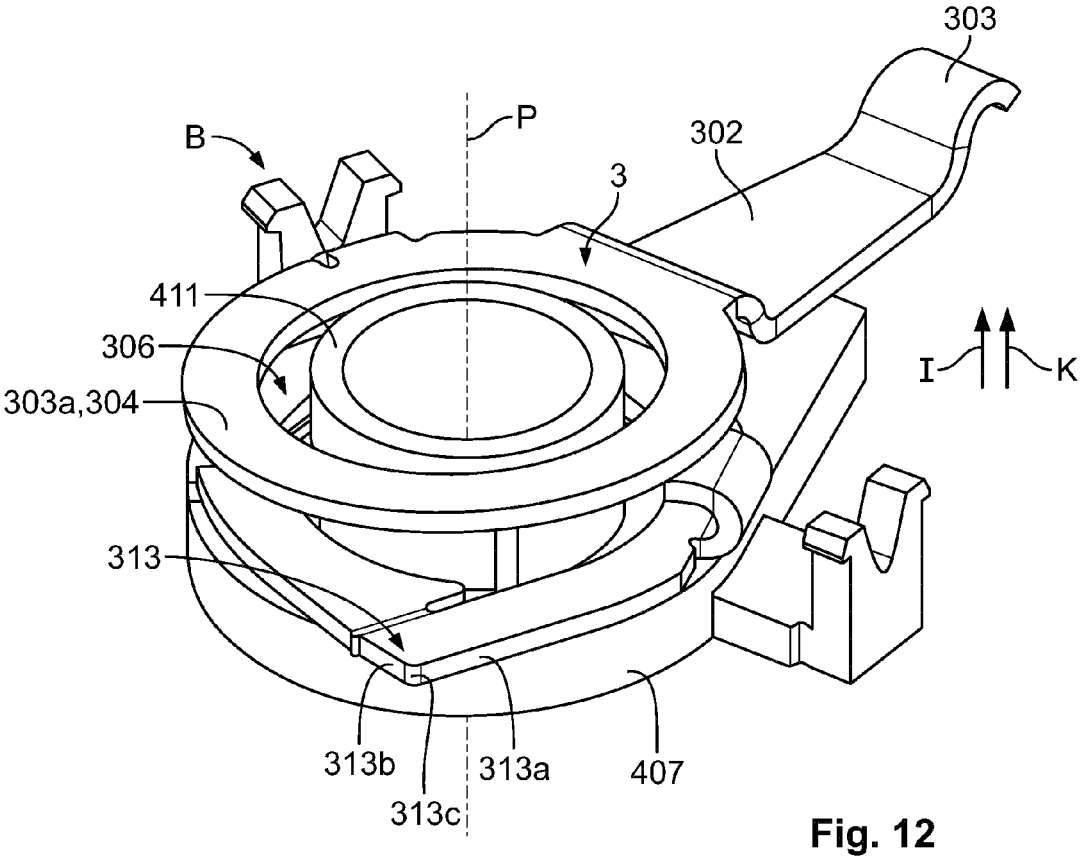
FIG. 12 is another schematic perspective view of the contact element and the clamping element illustrated in FIG. 11.
Figure 13:
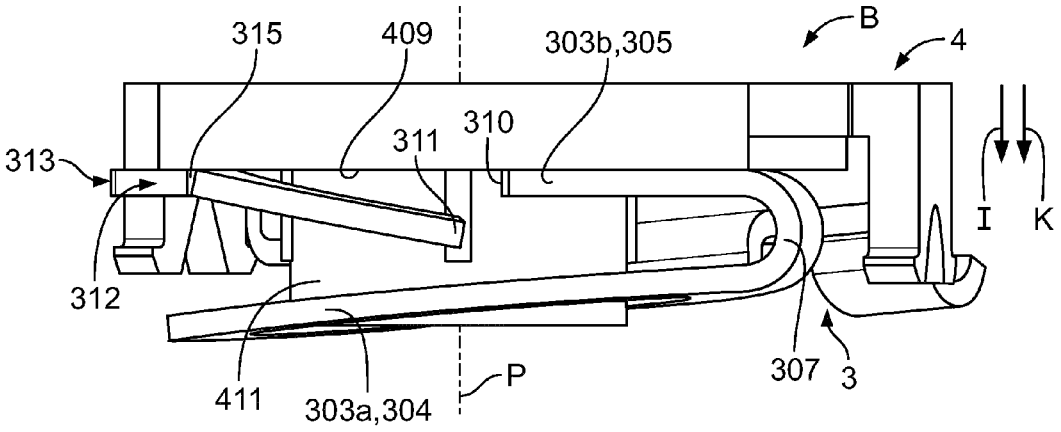
FIG. 13 is a schematic side view of the contact element and the clamping element illustrated in FIGS. 11 and 12.
Figure 14:
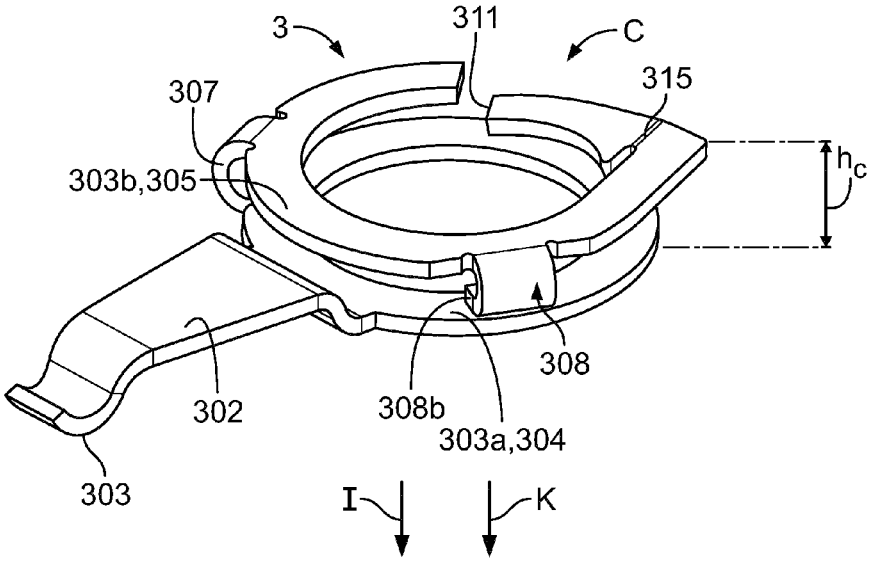
FIG. 14 is a schematic perspective view of the contact element used in the arrangement illustrated in FIG. 1 in an assembled state.

FIGS. 11 to 13 show the contact element 3 in interaction with the clamping element 4 in the pre-assembled state B. In FIG. 11, it becomes apparent that the holding section 402 is aligned with the contact arm 302 such that the holding section 402 is arranged above the contact arm 302. The ring members 303*a*, 303*b*, forming or comprising the base part 304 and the top part 305, respectively, are aligned with the side face 407, i.e. the outer circumference of the attachment section 401, such that they essentially cover each other in a projection along and against the insertion direction I as well as the contact direction K. In other words, the outer circumferences of the ring members 303*a*, 303*b* at least in section extend in parallel to the side face 407 in the region of the attachment section 401.

In FIG. 12, it becomes apparent that the sleeve 411 extends through the opening 306 such that the sleeve 411 and the opening 306 are arranged concentrically around the pivot axis P. The locking member 313 extends radially beyond the outer circumference of the base part 304 and ring member 303*a* as well as of the side face 407. In other words, the locking member 313 protrudes above the side face 407 perpendicularly to the insertion direction I and the contact direction K with its lateral abutment faces 313*a* and 313*b* as well as the edge 313*c* such that the edge may be brought into mesh with a counter locking member formed at the base 2. The counter locking member may simply be provided by a wall of the conductor chamber 204 and/or at least one the side walls 209 of the contact receptacle 203.

In FIG. 13, it becomes apparent that when the ring member 303*b* or top part 305*a*, respectively, is aligned with the bottom face 409. The second free end 311 is lifted off the bottom face 409.

The bridge element 307 and the entire base part 304 or ring member 303*a*, respectively, form a spring element or spring member each by which the contact element 3 is elastically deformable, i.e. compressible and/or expandable in the insertion direction I and contact direction K. The ring member 303*a* or base part 304, respectively, and the ring member 303*b* or top part 305, respectively, at least in part run in parallel to each other perpendicularly to the insertion direction I and contact direction K. The stop element 308 and in particular the leg 308*b* of the stop element 308 may abut the ring member 303*a* or base part 304, respectively.

Figure 15:
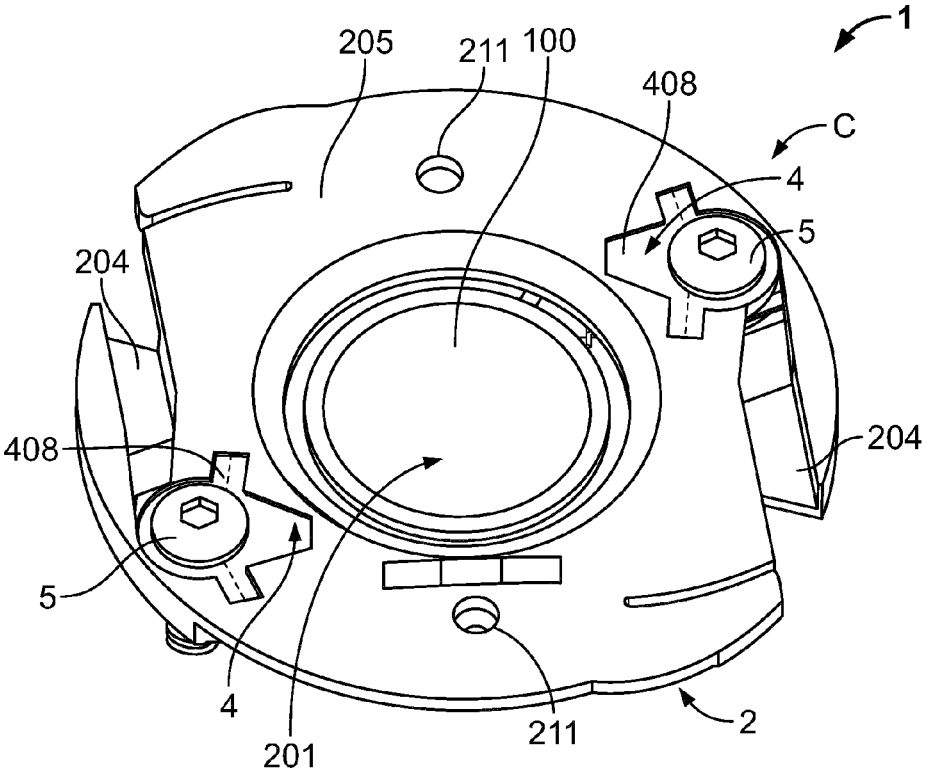
FIG. 15 is a schematic perspective view of the arrangement illustrated in FIG. 1 in the assembled state.

FIG. 15 shows the arrangement 1 in the assembled state C. The clamping elements 4 are fully inserted into the respective contact receptacles 203 such that top faces 408 are aligned with the top side 205 of the base 2. The latching elements 405*a* and 405*b* are fully inserted into the respective counter latching elements 210*a* and 210*b*, respectively. The contact elements 3 are held within the contact receptacles 203. The mounting elements 5 in the form of screws are brought into mesh with the through-holes 208, bores 403 and/or a carrier (not shown) for the assembly 1 so that they secure the clamping elements 4 in the assembled state C.

Figure 16:
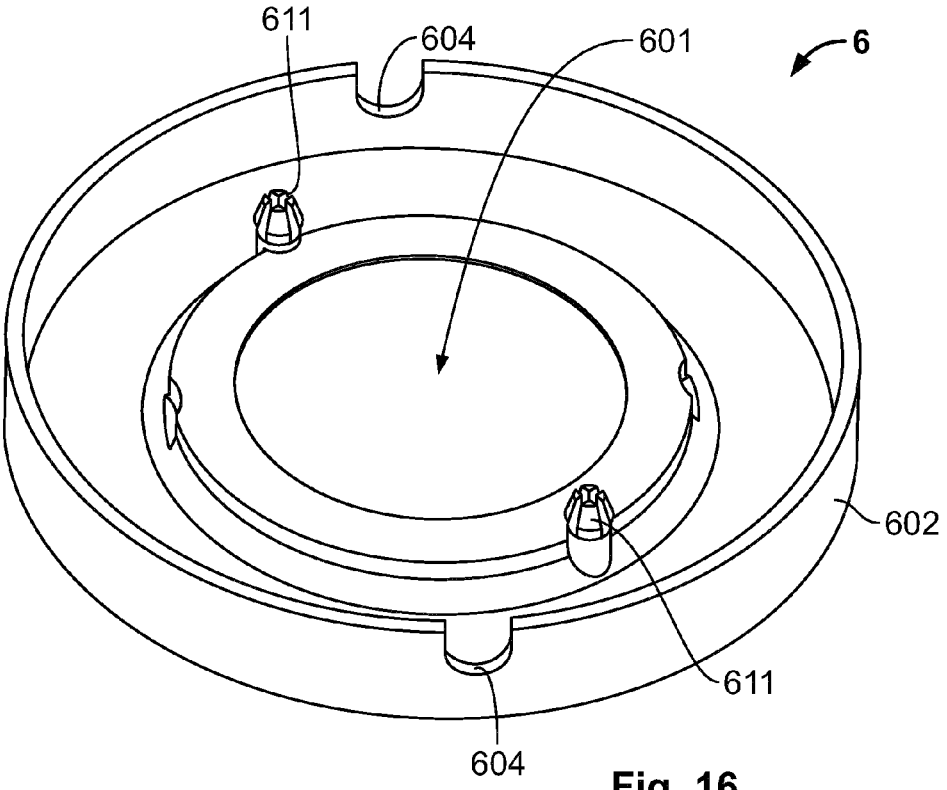
FIG. 16 is a schematic perspective view of a cover used in the arrangement illustrated in FIG. 1.

FIG. 16 shows the cover 6 in a schematic perspective view from below. The cover 6 is provided with a further orifice 601 which is adapted to placed concentrically with respect to the orifice 201. Counter attaching means 611 are designed to interact with the attaching means 211 in the form of pins are formed at the base 2 such that the cover 6 can be attached to the base 2. A lateral rim 602 of the cover is provided with the conductor openings 604, which are designed to be brought into alignment with the conductor channels 204 in order to lead an electrical conductor (not yet shown) beneath the cover 6.

Figure 17:
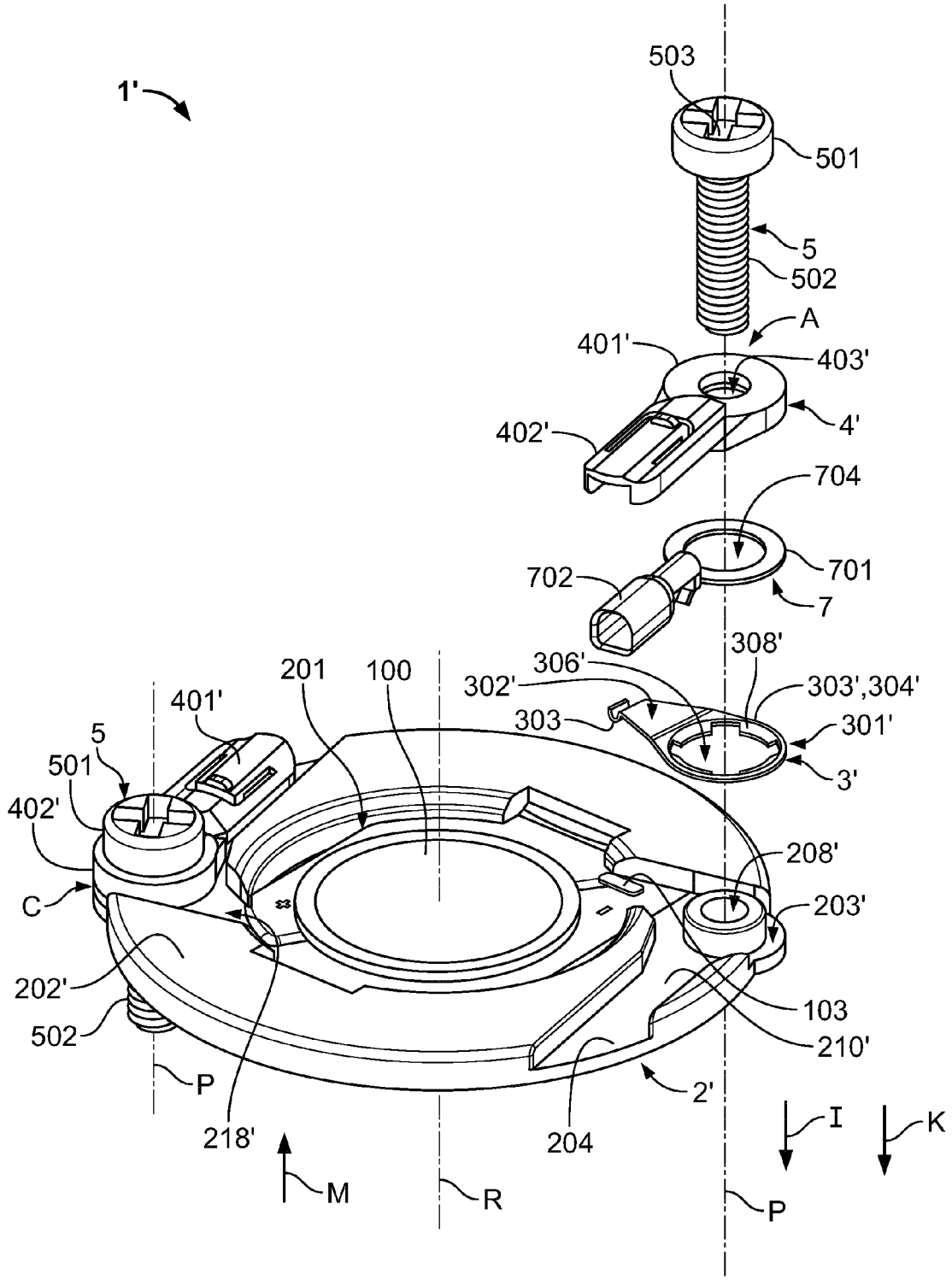
FIG. 17 is a schematic perspective partly exploded view of another embodiment of an arrangement for holding and electrically contacting an LED according to the present invention.

FIG. 17 shows an arrangement 1' for holding and electrically contacting an LED 100 according to another embodiment of the present invention. In the description of the arrangement 1' and all further arrangements 1", 1'", 1"" according to embodiments of the present invention shown in the FIGS. 17 to 28, essentially only the differences from the embodiment shown in FIGS. 1 to 16 are explained. For the sake brevity and conciseness, equal or similar parts are denoted with the same reference signs. Different embodiments of elements and parts having an equal or at least similar functionality are denoted with the same reference numerals provided with a respective number of apostrophes indicating that a element or part with an equal or at least similar functionality in the form of a different embodiment of the present invention is at hand.

The arrangement 1' comprises a base 2', two contact elements 3', two clamping elements 4', two mounting elements 5', and may further comprise the LED 100. The base 2' is provided with contact receptacles 203' for receiving the contact element 3', the electrical conductor 7 and at least partly the clamping element 4'. The contact receptacle 203' comprises a through-hole 208', which is at least partially formed and surrounded by a bush 209' in the form of a sleeve extending concentrically to the pivot axis P and having a cylindrical shape with which it protrudes upwardly against the insertion direction I and contact direction K from a bottom 210' of the contact receptacle 203'. One set of contact element 3', electrical conductor 7, clamping element 4' and mounting element 5 is in the assembled state C, whereas the other set of contact element 3', electrical conductor 7, clamping element 4' and mounting element 5 is in the dismantled state A and ready to be assembled in the insertion direction I and contact direction K.

The contact element 3' differs from the contact element 3 in that a mounting section 301' of the contact element 3' merely comprises a ring member 303' comprising a ring part 304' from which spring members 308' protrude radially towards an opening 306'. The spring elements 308' extend radially towards the pivot axis P and at least partly in the insertion direction I and contact direction K. In other words, the spring elements 308' are slanted with respect to the insertion direction I and contact direction K such that they slightly protrude downwardly from the base part 304'. The contact arm 302' of the contact element 3' is shaped similarly to the contact arm 302 of the contact element 3.

The clamping element 4' comprises an attachment section 401' and a holding section 402'. The attachment section 401' is formed as a cap comprising a bore 403'. The holding section 402' protrudes laterally from the attachment section 401'. The mounting element 5 comprises a head portion 501 and a shaft portion 502 arranged concentrically with respect to each other in a projection along the pivot axis P. The head portion 501 is formed as a screw-head and provided with an operating element 503 in order to apply a torque acting about the pivot axis P upon the mounting element 5. The operating element 503 is formed as a cross-recess. The shaft portion 502 is formed as a threaded bolt. The electrical contact 7 comprises a contact portion 701 in the form of a loop, eye or eyelet. A terminal portion 702 of the electrical conductor in the form of a ferrule for crimping thereto an electrical line (not yet shown) protrudes laterally from the contact portion 701.

Figure 18A:
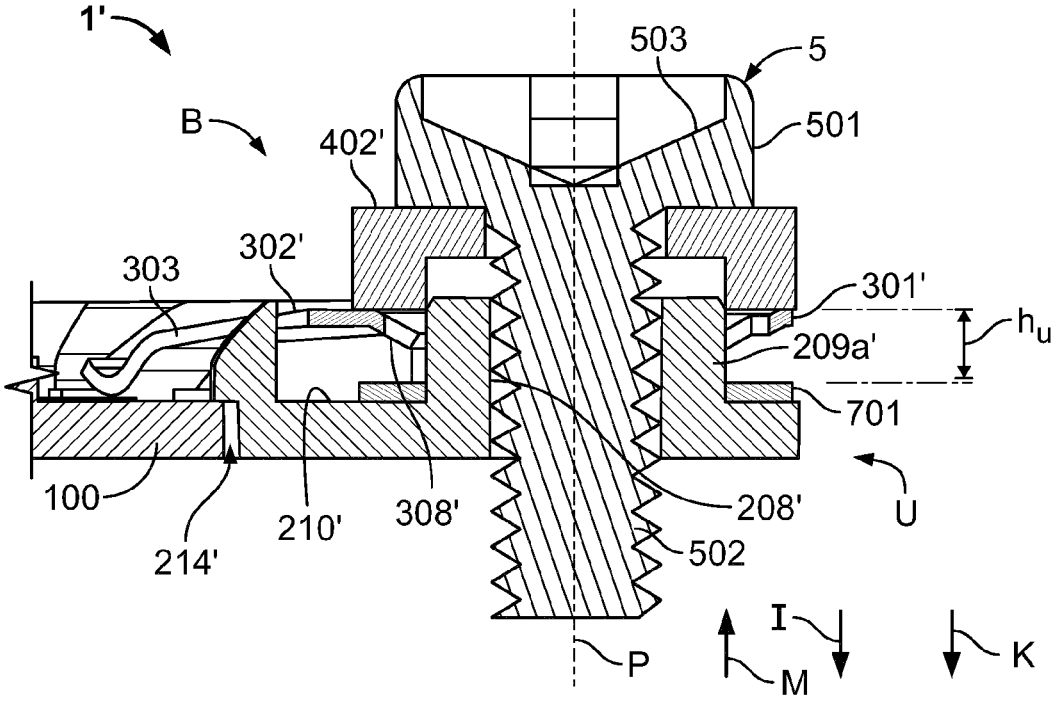
FIG. 18A is a schematic cross-sectional view along the pivot axis of a contact element according to an embodiment of the present invention shown in FIG. 17 in a pre-assembled state.

FIG. 18A shows a part of the arrangement 1' in the pre-assembled state B, wherein the electrical conductor 7 is mated with the base 2' in that its contact portion 701 abuts the bottom 210' of the contact receptacle 203' such that the bush 209*a*' protrudes through an eye 704 of the contact portion 701. The contact element 303 is inserted into the contact receptacle 203 such that the bush 209*a*' protrudes through the opening 306' defined by the ring member 303'. The attachment section 401' of the clamping element 4' abuts the mounting section 301' from above, i.e. in the insertion direction I and contact direction K. The shaft portion 502 of the mounting element 5 protrudes through the bore 403' and is in mesh with the inner circumference of the through-hole 208' such that a force acting in the insertion direction I and contact direction K exists that prevents the mounting element 5 from being detached from the base 2'. The head portion 501 of the mounting element 5 abuts the holding section 402' of the clamping element 4' from above and thereby prevents movement of the clamping element 4' against the insertion direction I and contact direction K.

In other words, the electrical conductor 7 is held captively between the bottom 210 of the contact receptacle 203' and the contact element 3. The contact element 3 is held captively between the electrical conductor 7 and the clamping element 4. The clamping element 4 is held captively between the head portion 501 of the mounting element 5 and the contact element 3. Further, the contact arm 302' protrudes through an aperture 218' of the base 2' from the contact receptacle 203' into the LED-receptacle 214' where the LED 100 is arranged. In the pre-assembled state B, the contact point 303 of the contact element 3' is not in contact with the LED-contact 103. The contact element 3 has a height in the uncompressed state $H_U$.

Figure 18B:
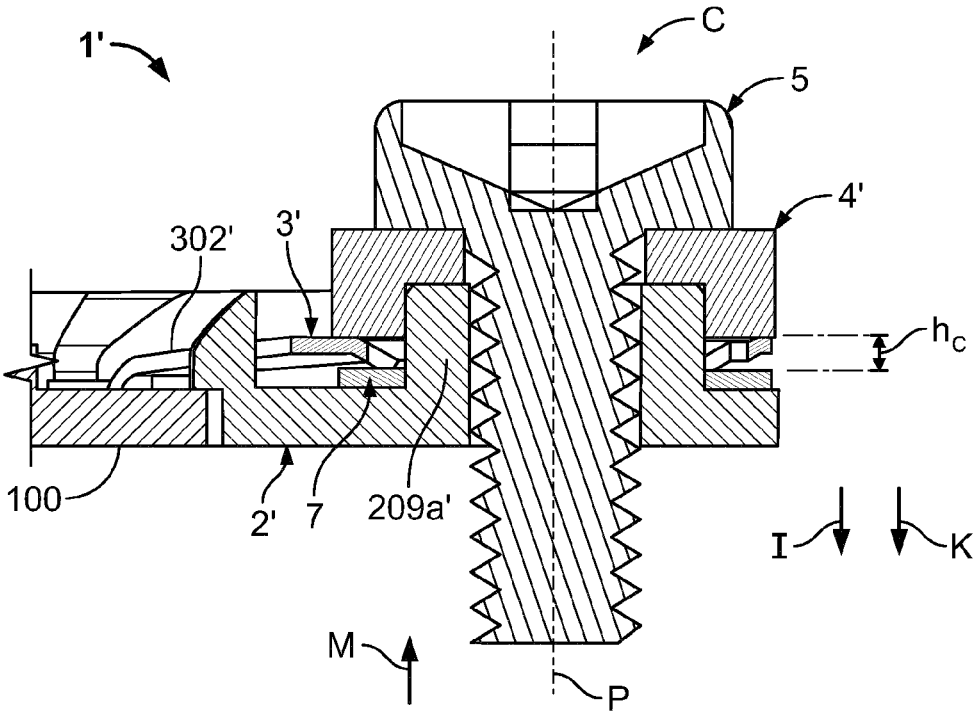
FIG. 18B is a schematic cross-sectional view of the contact element shown in FIG. 18A in an assembled state.

FIG. 18B shows the part of the arrangement 1' illustrated in FIG. 18A in the assembled state C. In the assembled state C, the mounting element 5 is further inserted in the insertion direction I such that the head portion 501 presses down the attachment section 401' such that it is jammed between the head portion 501 and the upper rim of the bush 209*a*. A rim protruding downwardly from the bore 403' pushes onto the mounting section 301' in the insertion direction I and the contact direction K such that the contact element 3' is urged and pressed, thereby compressed in the insertion direction I and contact direction K. The mounting section 301' is jammed between the attachment section 401' and the contact portion 701. The contact portion 701 is pressed against the bottom 210' of the contact receptacle 203'. Hence, the contact arm 302' moves downwardly and comes into contact with the LED-contact 103 while getting spring-tensioned. Further, the spring elements 308' are put under a spring tension in that they slightly bend upwardly against the insertion direction I and contact direction K such that the contact element 3' is compressed and has a reduced height $h_C$ in the assembled state C, i.e. compressed state, with respect to the uncompressed state U.

Figure 19:
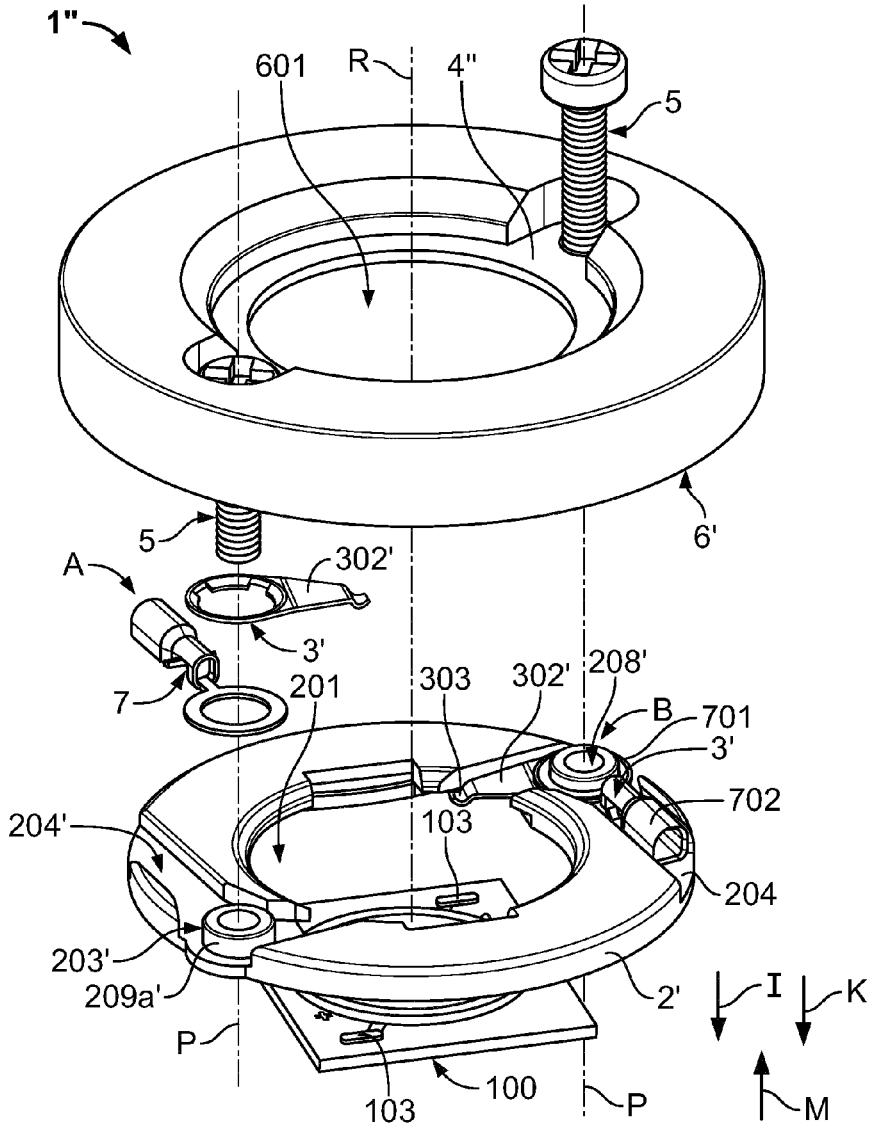
FIG. 19 is a schematic perspective exploded view of another embodiment of an arrangement for holding and electrically contacting an LED according to the present invention.

FIG. 19 shows an arrangement 1" according to another embodiment of the present invention which comprises the base 2', the contact elements 3 and may further comprise the electrical conductors 7 as well as the LED 100. In FIG. 19, one set of contact element 3' and electrical conductor 7 is shown in the dismantled state A whereas the other set of contact element 3' and electrical conductor 7 is shown in the pre-assembled state B, wherein the contact element 3' and the electrical conductor 7' are inserted into the contact receptacle 203' such that the bush 209*a*' protrudes through the mounting section 301' and contact portion 701'. A clamping element 4" is integrated into the cover 6'.

Figure 20:
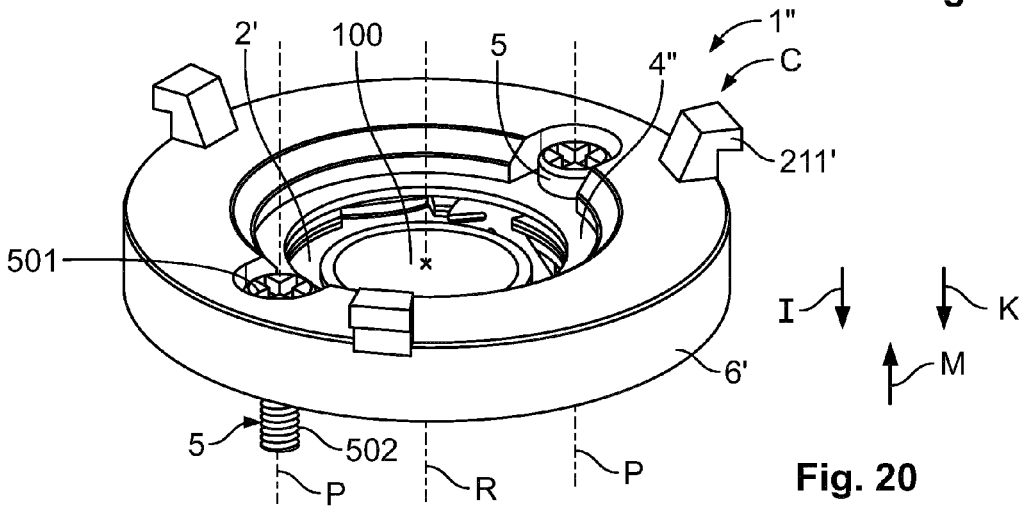
FIG. 20 is a schematic perspective view of the arrangement shown in FIG. 19 in an assembled state.

FIG. 20 shows the arrangement 1" in the assembled state C, wherein the cover 6' is mated with the base 2' in that the mounting elements 5 are in mesh with the inner contour of the through-hole 208' such that the clamping element 4" is pressed downwards towards the contact element 3', which is jammed between the clamping element 4" and the electrical conductor 7. The electrical conductor 7 is supported at the bottom 210' of the contact receptacle 203'. Further, the LED 100 may be inserted into the LED-receptacle 214' such that the electrical contacts 103' are in contact with the respective contact points 303 of the contact element 3' in the compressed state C.

Figure 21:
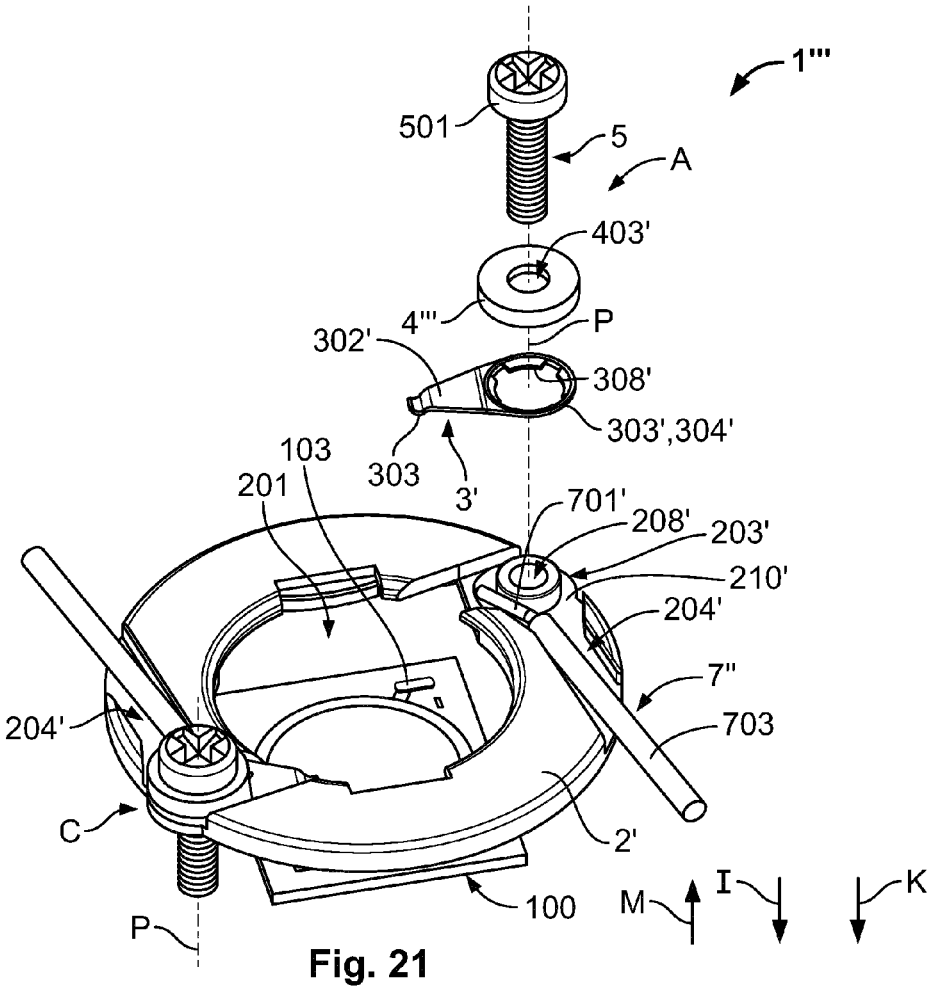
FIG. 21 is a schematic perspective partly exploded view of another embodiment of an arrangement for holding and electrically contacting an LED according to the present invention.

FIG. 21 shows a further embodiment of the arrangement 1'" for holding and electrically contacting at least one of the LED's 100 according to the present invention. Here, the base 2', the contact element 3', the mounting elements 5 and the LED 100 are combined with a clamping element 4" and electrical conductor 7". One set of contact element 3', clamping element 4'", mounting element 5 and electrical conductor 7" is shown in the dismantled state A, whereas the other set of said parts is shown in the assembled state C. The clamping element 4'" has the shape of a washer, i.e. an annular ring providing the bore 403'. The electrical conductor 7" comprises a contact portion 701' in the form of a bare or stripped section of the electrical conductor 7". A line 703' of the electrical conductor is formed as insulated part of the electrical conductor in the form of a cable.

Figure 22:
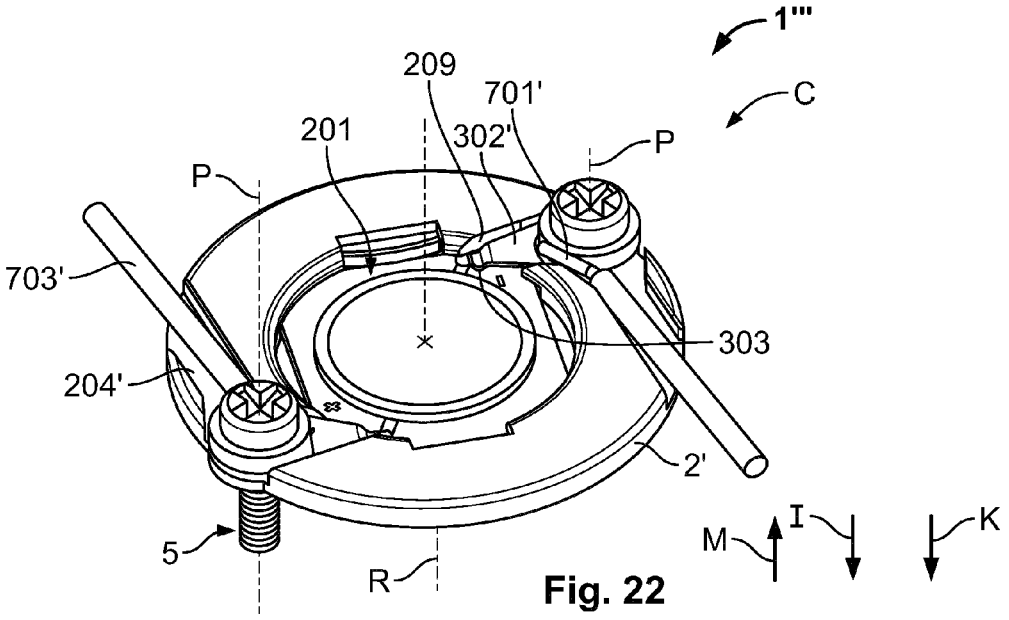
FIG. 22 is a schematic perspective view of the arrangement shown in FIG. 21 in an assembled state.

FIG. 22 shows the arrangement 1'" in the assembled state C, wherein the mounting elements 5 are in mesh with the respective inner circumferences of the through-holes 208', thereby jamming the contact portion 701', the ring member 303' and the clamping element 4'" between the head portion 501 and the bottom 210' of the contact receptacle 203'. Both lines 703' are arranged within the respective conductor channels 204'. The contact point 303' of each of the contact elements 3' are pressed towards the LED-contacts 103.

Figure 23:
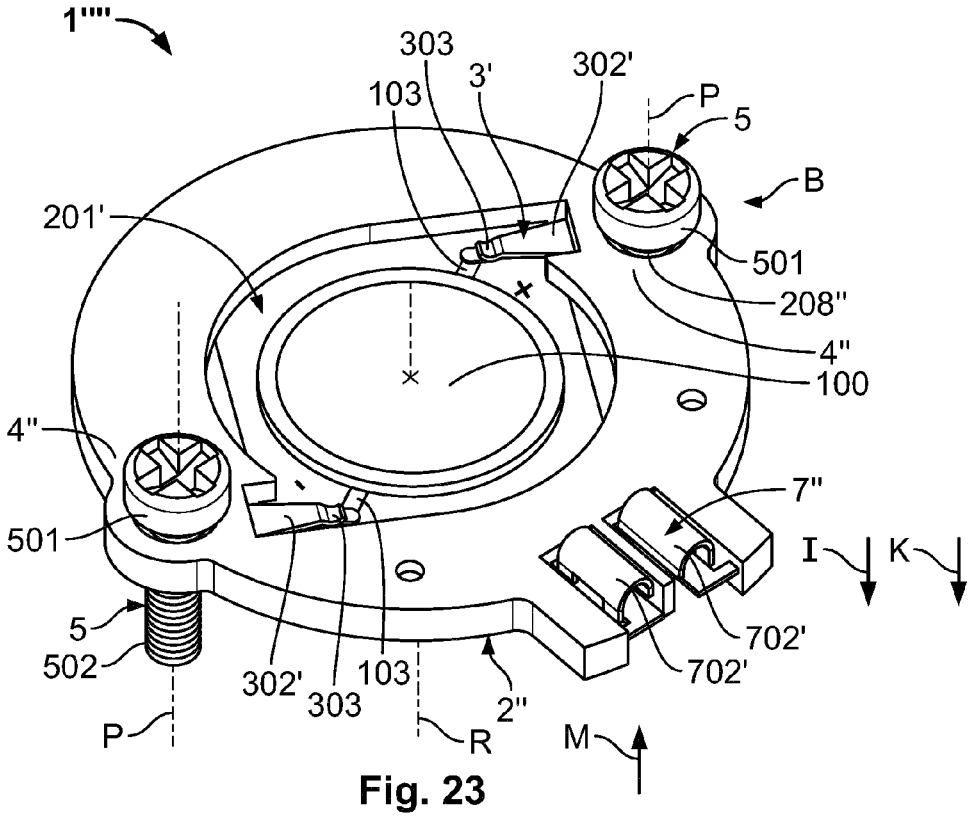
FIG. 23 is a schematic perspective view of another embodiment of an arrangement for holding and electrically contacting an LED according to the present invention in a pre-assembled state.

FIG. 23 shows another embodiment of an arrangement 1"" according to the present invention. The arrangement 1"" comprises a base 2", two contact elements 3' and may further comprise the two mounting elements 5 as well as the LED 100. In the arrangement 1"", two electrical conductors 7" are integrated into the base 2". Also, the clamping element 4" is integrated into the base 2".

Figure 24:
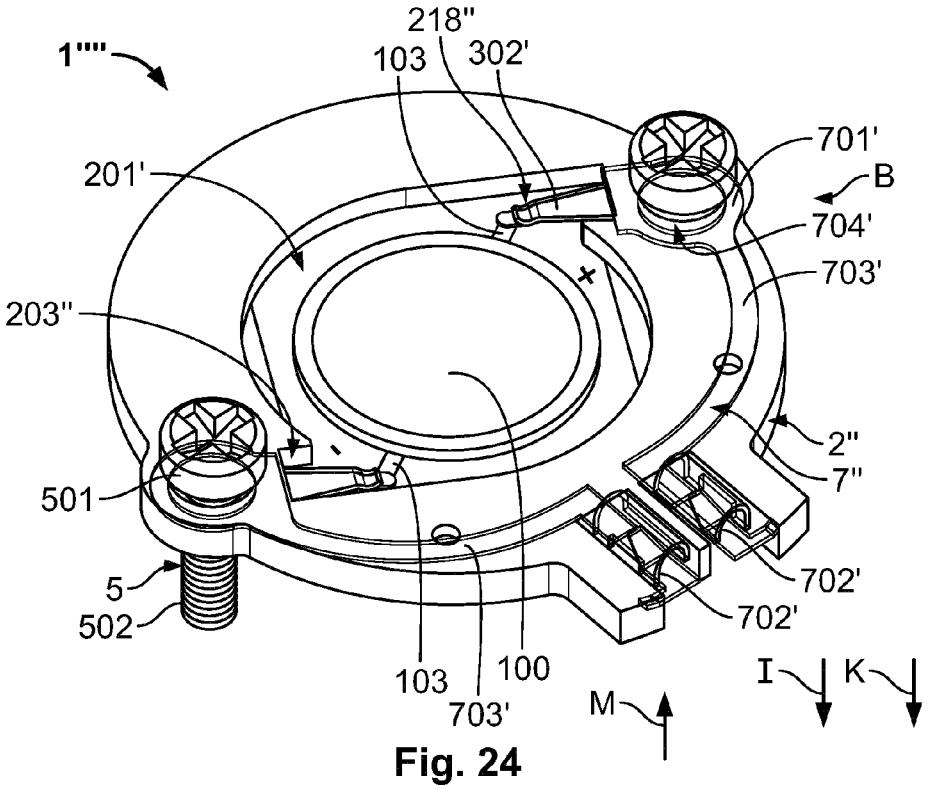
FIG. 24 is a schematic perspective view of the arrangement illustrated in FIG. 23, wherein the base is illustrated in a cross-sectional view along electrical conductor paths arranged within the base.

FIG. 24 shows the arrangement 1"" in the pre-assembled state B, wherein the base 2" is illustrated in a cross-sectional view along the electrical conductor 7", which has terminal portions 702' formed as a ferrules for inserting an electrical line in the form of a cable for example. From the terminal portion 702', lines 703' extend towards the respect contact portions 701', which provide an eye 704' for accommodating a shaft 502 each.

Figure 25:
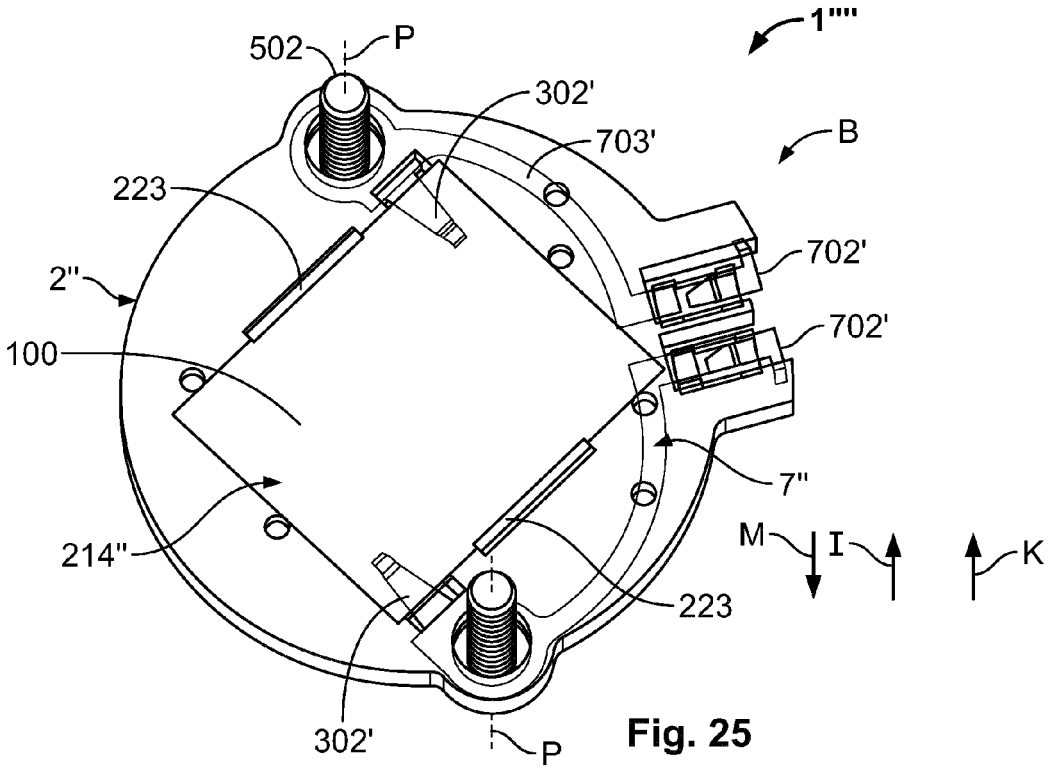
FIG. 25 is another schematic perspective view of the arrangement shown in FIGS. 23 and 24, wherein the conductor paths shown in FIG. 24 are illustrated in a cross-sectional view from below.

FIG. 25 shows the arrangement 1"" from below, wherein the base 2" is shown in partly cross-sectional view such that the electrical conductor 7" is visible. Here it becomes apparent that the contact arms 302' protrude through apertures 218" of the contact receptacles 203" into an LED-receptacle 214" of the base 2". At two electrical sides of the LED-receptacle 214", the base 2" is provided with fixing elements 223' in the form of brackets extending along and below the LED-receptacle 214" such that the LED 100 may be captively held therein.

Figure 26:
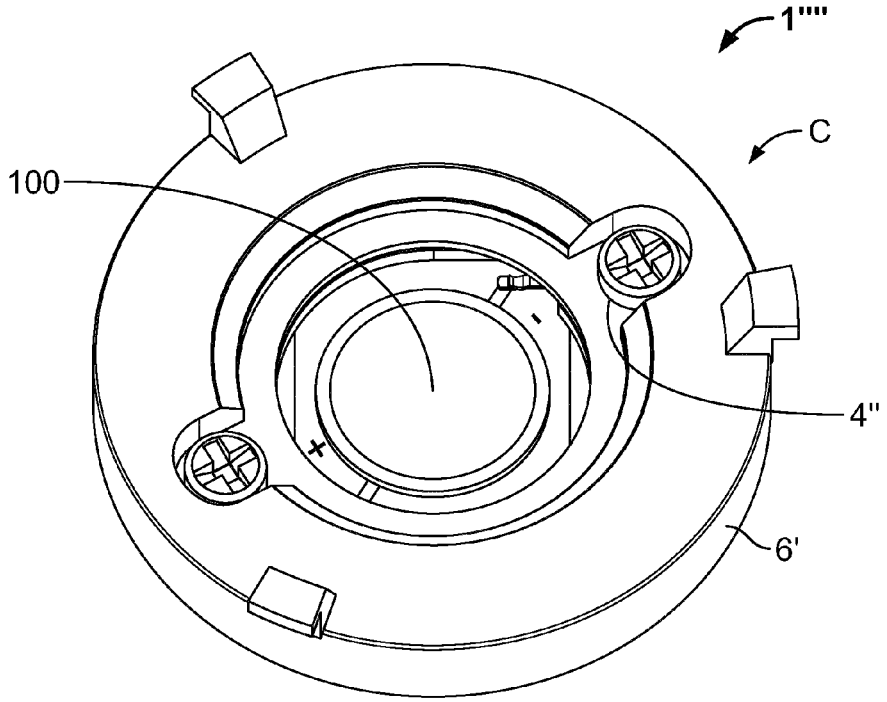
FIG. 26 is a schematic perspective view of the arrangement shown in FIGS. 23 to 25 in an assembled state.

FIG. 26 shows the arrangement 1"" in the assembled state C, wherein the cover 6' is provided, which is mounted to the base 2" in a manner described above, thereby compressing the contact element 3' within the contact receptacle 203" in a manner according to the present invention.

Figure 27:
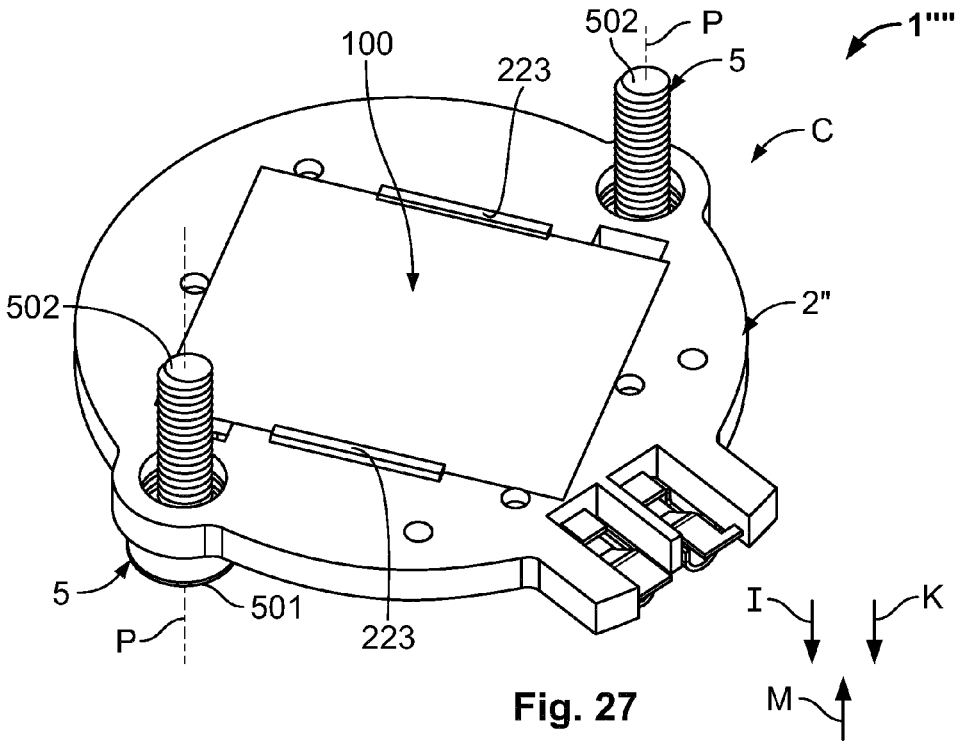
FIG. 27 is a schematic perspective view of the arrangement shown in FIG. 26 from below.

FIG. 27 shows a schematic perspective view of the arrangement 1"" in the assembled state C from below. Here it becomes apparent that the LED 100 is captively held between the fixing elements 223 and an abutment face 216' of the LED-receptacle 214". The shaft portions 502 protrude downwardly in the insertion direction I and contact direction K and against in the mating direction M from the base 2" such that they may further be mated with any support, carrier and/or substrate for holding the arrangement 1"".

Figure 28:
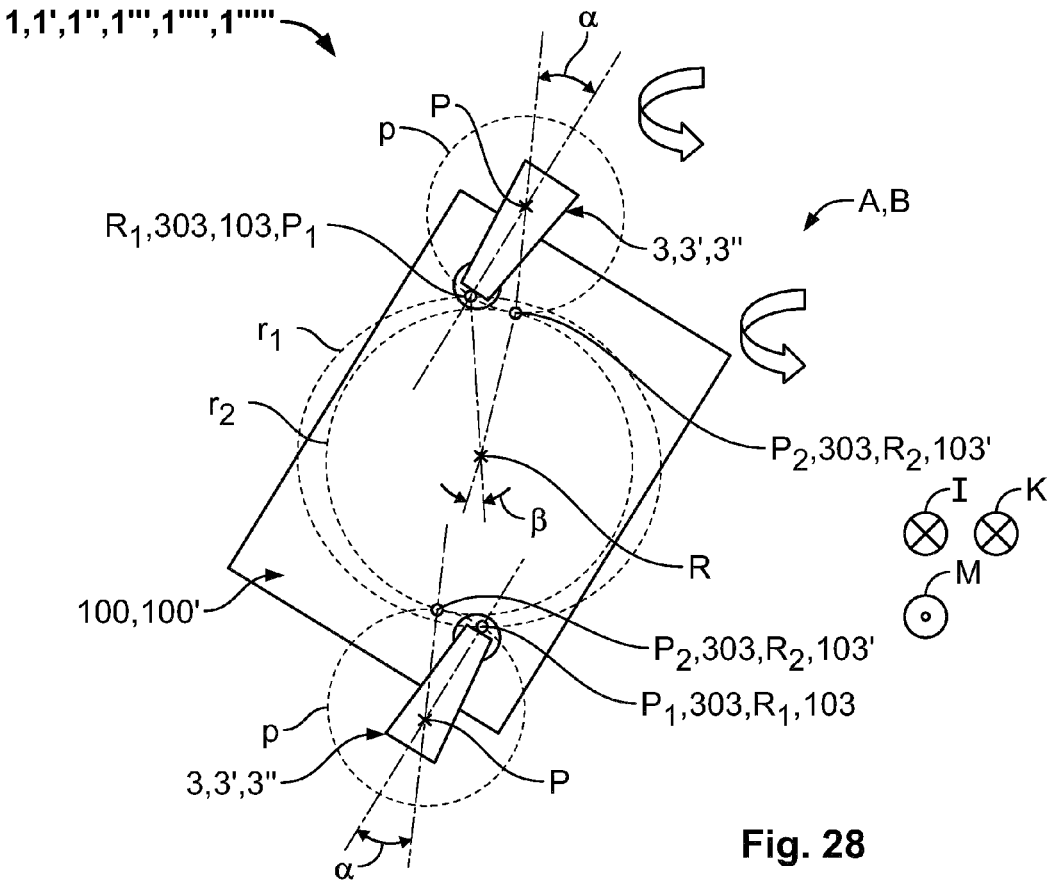
FIG. 28 is a schematic illustration of the functional principle of embodiments of arrangements for holding and electrically contacting an LED according to the present invention.

FIG. 28 shows schematic view of the arrangements 1, 1', 1", 1'", 1"", 1'"" according to embodiments of the present invention in a top-view. Here, the pivotable nature of the contact elements 3, 3', 3" and the LED 100 as well as another embodiment of the LED 100' is schematically illustrated. The contact elements 3, 3', 3", at least in the dismantled state A and the pre-assembled state B, are rotatable about the respective pivot axis P such that their contact points 303, 303', 303" may swivel along a contact radius p into at least two pivoting positions $P_1$ and $P_2$ corresponding to a pivot angle of $\alpha$. The LED's 100 and 100' may rotate about the rotational axis R such that respective LED-contacts 103 and 103' travel along a first LED-radius $r_1$ and a second LED-radius $r_2$, respectively. The second LED-radius $r_2$ is smaller than the first LED-radius $r_1$. The LED-contacts 103 and 103' may thereby travel along the first LED radius $r_1$ and the second LED radius $r_2$, respectively, between at least two rotational positions $R_1$ and $R_2$, respectively. In the pivoting position $P_1$, the contact point 303 is aligned with the LED-contact 103 in the rotational position $R_1$ of the LED 100. For contacting the LED-contact 103', the LED 100' is rotated with a rotational angle $\beta$ into the rotational position $R_2$ and the contact point 303 is swiveled along the contact radius p into the pivoting position $P_2$ such that it is aligned with the LED-contact 103'.

Figure 29:
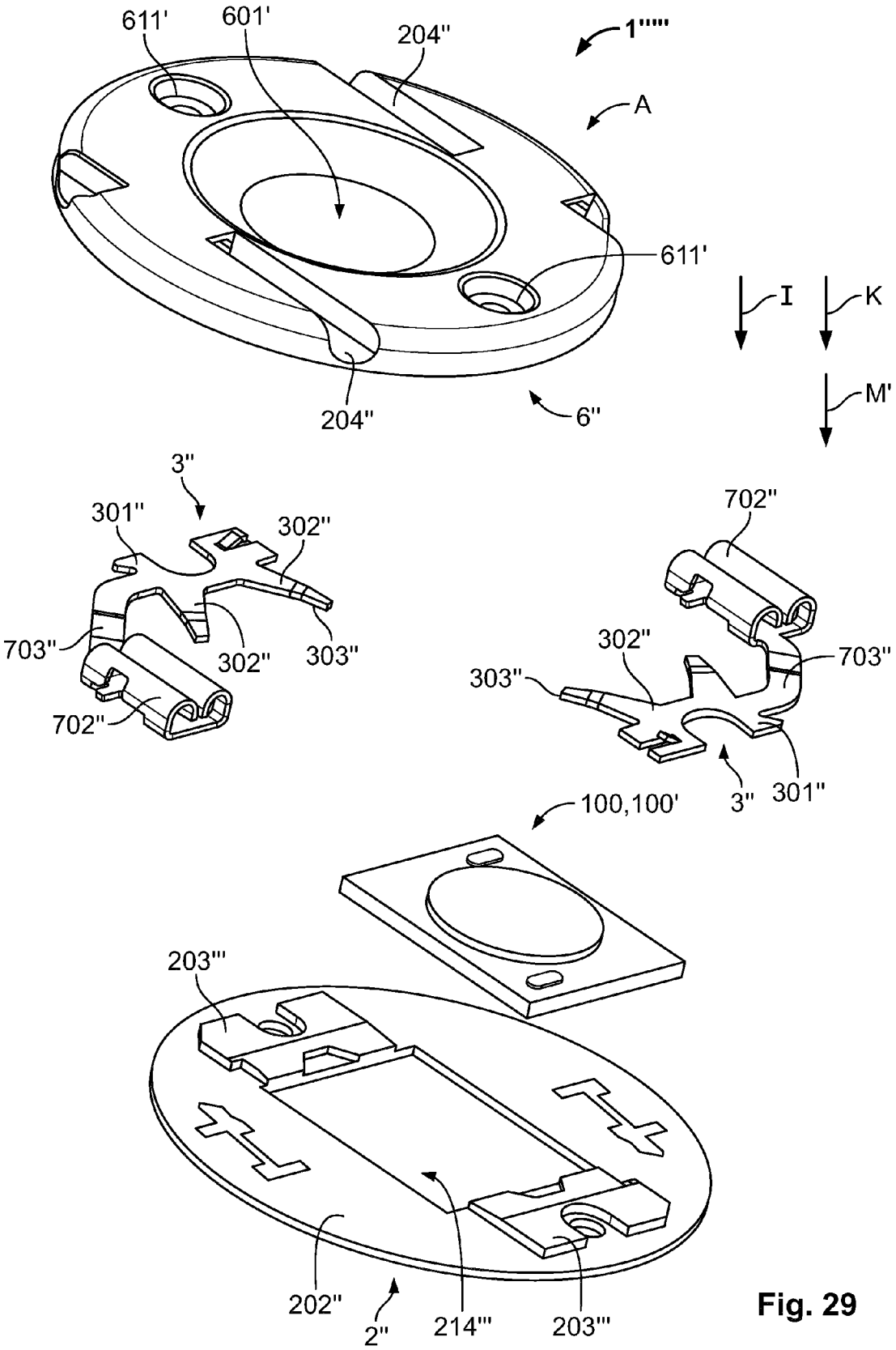
FIG. 29 shows a schematic perspective exploded view of another embodiment of an arrangement for holding an electrically contacting an LED according to the present invention in the dismantled state.

FIG. 29 shows another embodiment of an arrangement 1'"" according to the present invention. The arrangement 1'"" comprises a base 2", two contact elements 3" and may further comprise an LED 100, 100' as well as a cover 6".

The base 2" has a body portion 202" which is provided with two contact receptacles 203" in the form of contact pads adapted for welding or soldering mounting sections 301" of each of the contact elements 3" thereto, e.g. by ultrasonic welding and/or other connecting and bonding technologies, such as soldering or any surface mount device (SMD) attaching technologies. The contact elements 3" may be mated with the respective receptacles 203" in the insertion direction I and/or contact direction K. Further, the base 2" may comprise an LED-receptacles 214" for receiving the LED 100, 100'. The LED-receptacle 214" may be formed such that the LED 100, 100' may be mated with the base 2" in a mating direction M' which may run in parallel and in the same direction as the insertion direction I and/or the contact direction K.

The contact elements 3" may comprise two contact arms 302" with respective contact points 303" each. The contact arms 302" with the contact points 303" on their distal ends may protrude laterally from the respective mounting section 301". A terminal portion 702" may be connected to or integrated into the contact elements 3", e.g. via a line 703". The cover 6" may comprise an orifice 601' and counter attaching means 611'. Further, the conductor channels 204" may be integrated into the cover 6".

Figure 30:
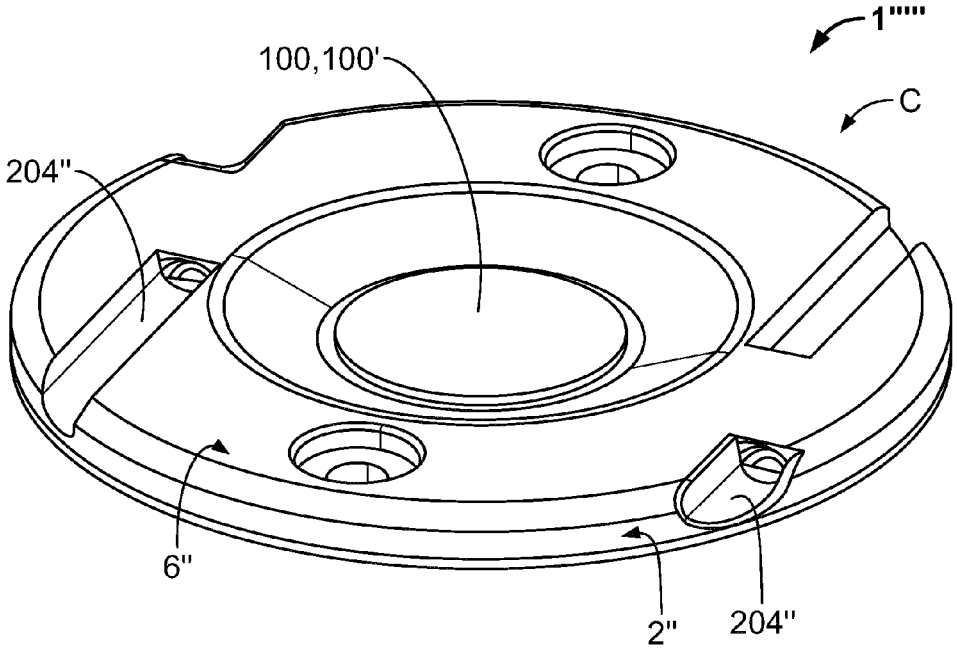
FIG. 30 is a schematic perspective view of the arrangement shown in FIG. 29 in the assembled state.

FIG. 30 shows the arrangement 1'" in the assembled state C. Here, the LED 100, 100' is inserted and/or placed above the LED-receptacle 214". The contact elements 3" are attached with their mounting sections 301" to the contact receptacles 203'". The cover 6" is joined with the base 2"

such that the contact elements 3" and the LED 100, 100" are sandwiched between the base 2" and the cover 6". This is especially advantageous for using ultrasonic welding in order to connect the base 2" to the cover 6". Thereby, an overmoulding for protecting the electrical contacts 3" and/or the LED 100, 100' may be omitted. Also, safety specifications may be met. The whole arrangement 1"" may be provided as one piece, i.e. its parts, the base 2", the contact elements 3", the cover 6" and/or the LED 100, 100' may be firmly bonded together.

Figure 31:
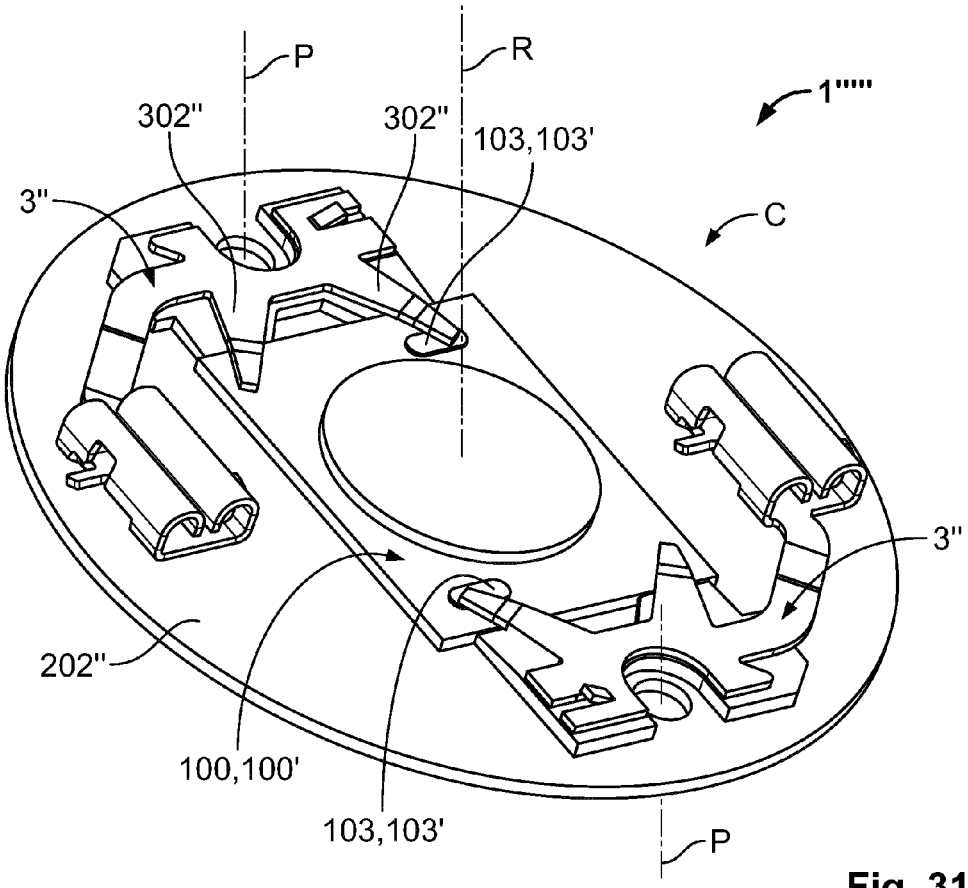
FIG. 31 shows a base and two contact elements of the arrangement illustrated in FIGS. 29 and 30 as well as an LED in the assembled state.

FIG. 31 shows the arrangement 1"" in a schematic perspective view in the assembled state C, wherein it becomes apparent that the contact elements 3" may each have a pivot axis P, about which the position of their respective contact arms 302" may be adjusted to the specifications of the LED 100, 100'. Also, the position of the LED 100, 100' may be adjusted by rotation about its rotational axis R.

Deviations from the above-described embodiments of the present invention are possible without departing from the scope of the present invention. Generally, contacting the LED contacts 103, 103' is realized by generating a spring force, i.e. by having spring action between the contact points 303, 303', 303". The spring force F may act in the insertion direction I and/or contact direction K and may be generated by the help of the mounting element 5 and/or by directly mounting the contact element 3, 3', 3" to the contact receptacle 203, 203', 203" via bonding technologies and/or soldering. Hence, any possible relaxation of the contact arm 302, 302', 302" is addressed in a robust way.

Further, not only an electrical contact may be generated between the base 2, 2', 2", the contact element 3, 3', 3", the clamping element 4, 4', the mounting element, the cover 6, 6', 6" and/or the LED 100, 100' as well as the LED contacts 103, 103', but also a thermally effective contact may be generated in order to dissipate thermal energy. The LED 100, 100' may be pushed towards a heat sink and/or brought into thermally conductive contact with the heat sink (not shown) in the insertion direction I and/or the contact direction K, i.e. from the base 2, 2', 2" downwardly in order to dissipate thermal energy.

A mounting section comprising at least a base part 304, 304' and a top part 305, 305', which may be formed as ring members 303*a*, 303*b*, respectively, may be used for realizing a poke-in function for an electrical conductor 7, 7", i.e. an electrical wire may be inserted between the base part 304, 304' and the top 305, 305', wherein also the free ends 310, 311 may be used for realizing the poke-in function. Hence, also the opening 306, 306' may in the dismantled state A and/or the pre-assembled state B allow for pushing in an electrical conductor 7, 7", i.e. a free space 7' for accommodating an electrical conductor may be provided between the base part 304, 304' and the top part 305, 305' as well as by the break 309.

The embodiments of the arrangement 1, 1', 1", 1''', 1"", 1''''', the base 2, 2', 2", 2''', the contact element 3, 3', 3", the clamping element 4, 4', 4", the mounting element 5, the cover 6, 6', 6", the electrical conductor 7, 7", the free space 7' for the electrical conductor and/or the LED according to the present invention may be formed and combined as required in a desired application and may provide the dismantled state A, a pre-assembled state B, an assembled state C, a mating direction M, M', an insertion direction I, a contact direction K, a pivot axis P, a rotational axis R, a centre point $M_P$ of a through-hole, a centre point $M_R$ of an orifice, an uncompressed state U, a compressed state C, a height in the uncompressed state $H_U$, a height in the pre-assembled stat $H_B$, a height in the assembled/compressed state $H_C$, pivoting positions $P_1$, $P_2$, contact radius p, rotational position $R_1$, $R_2$, LED radius $r_1$, $r_2$, pivot angles $\alpha$ and/or rotational angles $\beta$ as afforded by the respective application. The LED 100, 100' may have LED elements 101, substrates 102, LED contacts 103, 103' and upper sides 104 as required by a certain application.

The base 2, 2', 2" may have orifices 201, 201', body portions 202, 202', 202", contact receptacles 203, 203', 203", conductor channels 204, 204', 204", top sides 205, mounting portions 206, contact portions 207, openings/through-holes 208, 208', 208", side walls 209, bushes 209*a*, sleeves 209*a'*, bottoms 210, 210' of contact receptacles, counter latching elements 210*a*, 210*b*, attaching means 211, slots 212, bottom sides 213, LED-receptacles 214, 214', 214", 214''', frames 215, abutment faces 216, 216", contact recesses 217, apertures 218, 218', 218", locking elements 219, latching tongues 220, noses 221, further latching noses 222 and/or fixing elements 223 in any form and number required by a certain application for holding, electrically contacting and/or thermally contacting at least one LED 100.

The contact element 3, 3', 3" may be provided with mounting sections 301, 301', 301", contact arms 302, 302', 302", first bends 302*a*, second bends 302*b*, cantilever portions 302*c*, third bends 302*d*, bows 302*e*, free ends/distal ends 302*f*, contact points 303, 303', 303", ring members 303*a*, 303*b*, base parts 304, 304', top parts 305, 305', openings 306, 306', bridge elements/spring elements 307, first and second legs 306*a*, 307*b*, yokes 307*c* of bridge elements 307, stop elements 308, spring elements 308', legs 308*a*, 308*b*, yokes 308*c* of stop elements/spring elements 307, breaks 309, first free ends 310, second free ends 311, yielding sections 312, lateral abutment faces 313*a*, 313*b*, edges 313*c*, locking members 313 and/or notches 313 in any form and number required by a desired application.

The clamping element 4, 4', 4" may be provided with attachment sections 401, 401', holding sections 402, 402', bores 403, 403', tips 404, latching elements 405*a*, 405*b*, crossbeams 406, side faces 407, top faces 408, bottom faces 409, latching organs 410, latching arms 410*a*, 410*b*, latching noses 410*c*, sleeves 411 and/or bosses 412 in any number and form required by a desired application.

The mounting element 5 may be provided with a head portion 501, a shaft portion 502 and/or an operating element 503 in any form and number desired. The mounting element 5 may be any element suited for connecting the base 2, 2', 2", the contact element 3, 3', 3", the clamping element 4, 4', 4", the cover 6, 6', 6" and/or the electrical conductor 7, 7" by form-fit, positive fit, force-fit, frictional fit and/or bonding, soldering, gluing and/or moulding.

The cover 6, 6', 6" may be provided with orifices 601, 601' and/or counter attaching means 611, 611' in any form and number required by a certain application. The electrical conductor 7, 7" may comprise contact portions 701, 701', terminal portions 702, 702', 702", lines 703, 703', 703" and/or eyes 704, 704' in any form, shape and number required by a desired application.

The invention claimed is:

1. A contact element for electrically contacting a light-emitting diode (LED), comprising a mounting section adapted for mounting the contact element to a base in a manner that the contact element is pivotable about a pivot axis (P) extending through the mounting section, and a contact arm protruding laterally from the mounting section and having on a distal end a contact point facing essentially in a contact direction (K) for contacting the LED, wherein the contact direction (K) is running essentially in parallel to the pivot axis (P) the mounting section comprises at least one spring element providing resiliency of the mounting section at least in parallel with the pivot axis.

2. The contact element according to claim 1, wherein the mounting section which provides an opening for mounting the contact element to the base, and wherein the pivot axis (P) extends axially through the opening.

3. The contact element according to claim 1, wherein contact arm is at least in sections resiliently deflectable in the contact direction (K).

4. The contact element according to claim 1, wherein the mounting section comprises at least two ring members arranged above each other along the pivot axis (P).

5. The contact element according to claim 4, wherein the at least two ring members are connected to each other via a bridge element.

6. The contact element according to claim 4, wherein a stop element is arranged between the at least two ring members, the stop element at least partly limiting movements of the at least two ring members towards each other.

7. The contact element according to claim 6, wherein the stop element is resilient at least in parallel to the pivot axis (P).

8. The contact element according to claim 4, wherein at least one of the ring members is broken and has two free ends which are displaced with respect each other in a direction parallel to the pivot axis (P).

9. The contact element according to claim 1, further comprising at least one lateral abutment face which is adapted to limit a rotation of the contact element about its pivot axis (P).

10. A base for holding a light-emitting diode (LED), comprising at least one contact receptacle which is adapted to accommodate a contact element according to claim 1 in at least two different rotational positions (R1, R2).

11. A base according to claim 10, further comprising an LED-receptacle adapted to accommodate the LED such that it is rotatable about a rotational axis (R) extending through the LED-receptacle.

12. A clamping element for clamping a contact element to a base:

wherein the contact element is for electrically contacting a light-emitting diode (LED), and comprises a mounting section adapted for mounting the contact element to a base in a manner that the contact element is pivotable about a pivot axis (P) extending through the mounting section, and a contact arm protruding laterally from the mounting section and having on a distal end a contact point facing essentially in a contact direction (K) for contacting the LED, wherein the contact direction (K) is running essentially in parallel to the pivot axis (P); and wherein the base comprises at least one contact receptacle which is adapted to accommodate the contact element in at least two different rotational positions (R1, R2), wherein the clamping element comprises an attachment section adapted to be attached to the base at the at least one contact receptacle, and a holding section adapted to hold down the contact arm of the contact element towards the LED.

13. An arrangement for holding and electrically contacting a light-emitting diode (LED), wherein the arrangement comprises at least one contact for electrically contacting a light-emitting diode (LED), and comprises a mounting section adapted for mounting the contact element to a base in a manner that the contact element is pivotable about a pivot axis (P) extending through the mounting section, and a contact arm protruding laterally from the mounting section and having on a distal end a contact point facing essentially in a contact direction (K) for contacting the LED, wherein the contact direction (K) is running essentially in parallel to the pivot axis (P).

14. The arrangement according to claim 13, further comprising a base for holding the light-emitting diode (LED), comprising at least one contact receptacle which is adapted to accommodate the contact element in at least two different rotational positions (R1, R2).

15. The arrangement according to claim 14, further comprising a clamping element comprising an attachment section adapted to be attached to the base at the at least one contact receptacle, and a holding section adapted to hold down the contact arm of the contact element towards the LED.

16. An arrangement according to claim 15, wherein in a preassembled position, the contact element is held captive in the contact receptacle by the clamping element.

17. A mounting section for mounting an electrical contact to a substrate, wherein the mounting section comprises a base part and a top part, which are placed above each other in an insertion direction (I) in which the mounting section is adapted to be mated with the substrate wherein the base part and the top part are elastically displaceable with respect to each other at least in the insertion direction (I).

18. A contact element for electrically contacting a light-emitting diode (LED), comprising a mounting section adapted for mounting the contact element to a base in a manner that the contact element is pivotable about a pivot axis (P) extending through the mounting section, and a contact arm protruding laterally from the mounting section and having on a distal end a contact point facing essentially in a contact direction (K) for contacting the LED, wherein the contact direction (K) is running essentially in parallel to the pivot axis (P),wherein the mounting section comprises at least two ring members arranged above each other along the pivot axis (P).

19. The contact element according to claim 18, wherein the mounting section provides an opening for mounting the contact element to the base, and wherein the pivot axis (P) extends axially through the opening.

20. The contact element according to claim 18, wherein contact arm is at least in sections resiliently deflectable in the contact direction (K).

21. The contact element according to claim 18, wherein the mounting section comprises at least one spring element providing resiliency of the mounting section at least in parallel with the pivot axis (P).

22. The contact element according to claim 18, wherein the at least two ring members are connected to each other via a bridge element.

23. The contact element according to claim 18, wherein a stop element is arranged between the at least two ring members, the stop element at least partly limiting movements of the at least two ring members towards each other.

24. The contact element according to claim 23, wherein the stop element is resilient at least in parallel to the pivot axis (P).

25. The contact element according to claim 18, wherein at least one of the ring members is broken and has two free ends which are displaced with respect each other in a direction parallel to the pivot axis (P).

26. The contact element according to claim 18, further comprising at least one lateral abutment face which is adapted to limit a rotation of the contact element about its pivot axis (P).

* * * * *